United States Patent [19]

Kida et al.

[11] Patent Number: 4,839,264

[45] Date of Patent: Jun. 13, 1989

[54] SILVER HALIDE PHOTOGRAPHIC MATERIAL

[75] Inventors: Shuji Kida; Yutaka Kaneko; Kenji Kadokura; Shinji Yoshimoto; Kosaku Masuda, all of Hino, Japan

[73] Assignee: Konishiroku Photo Industry Co., Ltd., Tokyo, Japan

[21] Appl. No.: 124,401

[22] Filed: Nov. 18, 1987

Related U.S. Application Data

[63] Continuation of Ser. No. 880,925, Jul. 1, 1986, abandoned.

[30] Foreign Application Priority Data

Jul. 4, 1985 [JP] Japan ..... 60-147456

[51] Int. Cl.[4] ..... G03C 7/38; G03C 1/46

[52] U.S. Cl. ..... 430/505; 430/551; 430/558

[58] Field of Search ..... 430/551, 558, 505

[56] References Cited

U.S. PATENT DOCUMENTS

| | | | |
|---|---|---|---|
| 4,559,297 | 12/1985 | Seto et al. | 430/558 |
| 4,562,146 | 12/1985 | Masuda et al. | 430/551 |
| 4,585,728 | 4/1986 | Furutachi et al. | 430/372 |
| 4,639,415 | 1/1987 | Kaneko et al. | 430/551 |

FOREIGN PATENT DOCUMENTS

| | | |
|---|---|---|
| 32699 | 7/1981 | European Pat. Off. . |
| 81768 | 6/1983 | European Pat. Off. . |
| 1810464 | 7/1969 | Fed. Rep. of Germany . |
| 2617826 | 11/1976 | Fed. Rep. of Germany . |

*Primary Examiner*—Paul R. Michl
*Assistant Examiner*—Mark R. Buscher
*Attorney, Agent, or Firm*—Jordan B. Bierman

[57] ABSTRACT

A silver halide photographic material containing at least one of couplers represented by the general formula [I] and at least one of the compounds represented by the general formula [XII] is disclosed.

Formula [I]

wherein Z is a group of nonmetal atoms necessary to complete a nitrogen-containing heterocyclic ring where the ring formed by Z may be substituted; X is a hydrogen atom or a substituent capable of being released upon reaction with the oxidation product of a color developing agent and R is a hydrogen atom or substituent;

Formula [XII]

wherein $R_{21}$ is a hydrogen atom or a group selected from the group consisting of an alkyl group, an alkenyl group, a cycloalkyl group and aryl group, $R_{22}$ and $R_{23}$ are independently selected from the group consisting of an alkyl group, an alkenyl group, a cycloalkyl group and an aryl group.

The photographic material provides a dye-image highly stable against heat and light, and a formation of stain at a non-image area is prevented.

14 Claims, No Drawings

SILVER HALIDE PHOTOGRAPHIC MATERIAL

This application is a continuation of application Ser. No. 880,925, filed July 1, 1986, now abandoned which, in turn, claims the priority of Japanese Application 147456/85, filed July 4, 1985.

BACKGROUND OF THE INVENTION

This invention relates to a silver halide photographic material and more particularly to a silver halide photographic material capable of keeping an dye image stable against heat and light and preventing a stain occurring.

It has so far been well-known that a silver halide color photographic material is exposed imagewise and color-developed, and thereby the oxidation products of a color developing agent and a color forming agent are reacted couplingwise with each other to produce such a dye as indophenol, indoaniline, indamine, azomethine, phenoxadine, phenazine and the like, so that a color image may be produced. In such a system as described above, a color reproduction is normally carried out in a substractive color process and there uses a silver halide color photographic material comprising blue-sensitive, green-sensitive and red-sensitive silver halide emulsion layers respectively containing complementary-color forming agents, namely, yellow, magenta and cyan color forming couplers.

The couplers which are to be used for forming the above-mentioned yellow color-image include, for example, an acylacetanilide-type coupler; the well-known couplers for forming a magenta color-image include, for example, a pyrazolone-, pyrazolobenzimidazole-, pyrazolotriazole- or indazolone-type coupler; and the couplers for forming a cyan color-image include, for example, a phenol- or naphthol-type coupler which is generally used.

It is desired that such a dye image obtained as above may neither be discolored nor be faded even if it should be exposed to light for a long time or preserved in a high temperature and humidity condition. With respect to a silver halide color photographic material (hereinafter called a color photographic material), it is demanded that the color-undeveloped areas thereof shall not be yellowed (hereinafter called Y-stain) by light or at a high humidity and temperature.

In the case of using a magenta coupler, however, such a Y-stain caused in a color-undeveloped area at a high humidity and temperature or a discoloration caused by light in a dye-image area are more serious than those caused in the case of using a yellow or cyan coupler. This problem has often led to an issue of color reproductions.

The couplers being popularly used to form a magenta dye include, for example, a 1,2-pyrazolo-5-one. It is a serious problem that the dyes prepared of the 1,2-pyrazolo-5-ones have a main absorption around 550 nm and besides a by-absorption around 430 nm. Therefore, various studies have been made to solve this problem.

The 1,2-pyrazolo-5-one type magenta couplers each having an anilino group in the 3rd position are especially useful for obtaining a color image for print use, because they are less in the above-mentioned by-absorption. The above-mentioned techniques are described in, for example, U.S. Pat. No. 2,343,703, British Patent No. 1,059,994 and the like.

Meanwhile, the above-mentioned magenta couplers have the disadvantages that the image preservability and particularly the fastness of dye images to light are seriously poor and that Y-stains in color-undeveloped areas are also serious.

The other means have been proposed for reducing the above-mentioned by-absorption around 430 nm from the magenta couplers. They include, for example, such a magenta coupler as a pyrazolobenzimidazole described in British Patent No. 1,047,612; and indazolone described in U.S. Pat. No. 3,770,447; an 1H-pyrozolo[5,1-c]-1,2,4-triazole type coupler described respectively in U.S. Pat. No. 3,725,067 and British Patent Nos. 1,252,418 and 1,334,515; an 1H-pyrozolo[1,5-b]-1,2,4-triazole type coupler described in Research Disclosure No. 24531; an 1H-pyrazolo[1,5-c]-1,2,3-triazole type coupler described in Research Disclosure No. 24626; an 1H-imidazo-[1,2-b]-pyrazole type coupler described respectively in Japanese Patent O.P.I. Publication No. 162548/1984 and Research Disclosure No. 24531; an 1H-pyrazolo[1,5-b]pyrazole type coupler described in Research Disclosure No. 24230; an 1H-pyrazolo[1,5-d]tetrazole type coupler described in Research Disclosure No. 24220; and the like. The dyes each prepared from the 1H-pyrazolo[5,1-c]-1,2,4-triazole type coupler, an 1H-pyrazolo[1,5-b]-1,2,4-triazole type coupler, an 1H-pyrazolo[1,5-c]-1;2,3triazole type coupler, an 1H-imidazo [1,2-b]pyrazole type coupler, an 1H-pyrazolo[1,5-d]pyrazole type coupler and an 1H-pyrazolo[1,5-d]tetrazole type coupler; such a dye as given above has the desirable advantages that it is preferred for color reproduction because the by-absorption thereof around 430 nm is remarkably less, and a Y-stain caused in color-undeveloped areas by light or at a high temperature and humidity is extremely less, as compared with the above-mentioned dyes each prepared of a 1,2-pyrazolo-5-one having an anilino group in the 3rd position.

However, the azomethine dyes prepared of the above-mentioned couplers are very poor in fastness against light and in addition they are apt to be faded by light, so that they will worsen, to a marked degree, the characteristics of a color photographic material, especially those for print use. Therefore, they have not yet been put in practical use.

In the meantime, Japanese Patent O.P.I. Publication No. 125732/1984 proposes a technique in which the light fastness of a magenta dye-image obtained from an 1H-pyrozolo-[5,1-c]-1,2,4-triazole type magenta coupler may be improved by jointly applying a phenol type compound or a phenylether type compound to an 1H-pyrazolo[5,1-c]-1,2,4-triazole type magenta coupler. Even this technique is still not fully satisfactory to prevent the light fading of the above-mentioned magenta dye-image and, in addition, it was found that such light discoloration prevention is nearly impossible.

SUMMARY OF THE INVENTION

This invention was made by taking the above-mentioned problems into consideration.

It is accordingly an object of the invention to provide a color photographic material excellent in color reproducibility and improved, to a great extent, on the light-fastness of a magenta dye-image.

Another object of the invention is to provide a color photographic material having a magenta dye-image substantially less in discoloration caused by light.

A further object of the invention is to provide a color photographic material capable of preventing the color-undeveloped areas thereof from the occurrence of Y-stain caused by light or in a high temperature and humidity condition.

The above-mentioned object of the invention can be achieved by a silver halide photographic material containing at least one of the couplers represented by the following General Formula [I] and at least one of the compounds represented by the following General Formula [XII]:

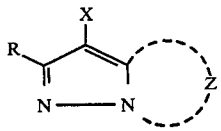

General Formula [I]

[wherein

Z represents a group of nonmetal atoms necessary to form a nitrogen-containing heterocyclic ring, and the ring formed by the z is allowed to have a substituent;

X represents a hydrogen atom or a substituent capable of splitting off through the reaction thereof with the oxidation products of a color developing agent; and R represents a hydrogen atom or a substituent.]

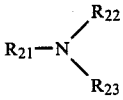

General Formula [XII]

wherein $R_{21}$ represents a hydrogen atom, an alkyl group, an alkenyl group, a cycloalkyl group or an aryl group; and $R_{22}$ and $R_{23}$ each represents an alkyl group, an alkenyl group, a cycloalkyl group or an aryl group.

DETAILED DESCRIPTION OF THE INVENTION

The invention will now be described in detail.

In the magenta couplers relating to the invention represented by the above-given Formula [I],

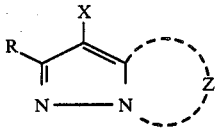

Formula [I]

wherein Z represents a group of non-metal atoms necessary for forming a nitrogen-containing heterocyclic ring, and any ring formed by the abovegiven Z is allowed to have substituents; X represents a substituent capable of splitting off through the reaction thereof to the oxidation products of a color developing agent; and R represents hydrogen or a substituent.

The substituents represented by the above-given R include, for example, a halogen, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclicoxy group, a siloxy group, an acyloxy group, a carbamoyloxy group, an amino group, an acylamino group, a sulfonamido group, an imido group, an ureido group, a sulfamoylamino group, an alkoxycarbonylamino group, an aryloxycarbonylamino group, an alkoxycarbonyl group, an aryloxycarbonyl group, an alkylthio group, an arylthio group, and a heterocyclicthio group.

A halogen includes, for example, chlorine and bromine, and more preferably among them, chlorine.

The alkyl groups represented by R include, for example, those each having 1 to 32 carbon atoms; the alkenyl groups and the alkynyl groups represented thereby include, for example, those each having 2 to 32 carbon atoms; the cycloalkyl groups and the cycloalkenyl groups represented thereby include, for example, those each having 3 to 12 carbon atoms and more preferably those each having 5 to 7 carbon atoms. The above-mentioned alkyl, alkenyl and alkynyl groups are allowed to be normal chained or branch chained.

The above-mentioned alkyl, alkenyl, alkynyl, cycloalkyl and cycloalkenyl groups are allowed to have such a substituent as an aryl group, a cyano group, a halogen, a heterocyclic group, a cycloalkyl group, a cycloalkenyl group, a spiro compound residual group and a cross linked hydrocarbon compound residual group. Besides the above, they are also allowed to have a substituent substituted through such a carbonyl group as that of acyl, carboxy, carbamoyl, alkoxycarbonyl or aryloxycarbonyl. They are further allowed to have such a substituent substituted through a hetero atom as, typically, those substituted through oxygen such as that of hydroxy, alkoxy, aryloxy, heterocyclicoxy, siloxy, acyloxy, carbamoyloxy or the like; those substituted through nitrogen such as that of nitro, amino including, for example, dialkylamino and the like, sulfamoylamino, alkoxycarbonylamino, aryloxycarbonylamino, acylamino, sulfonamido, imido, ureido or the like; those substituted through sulfur such as that of alkylthio, arylthio, heterocyclicthio, sulfonyl, sulfinyl, sulfamoyl or the like; and those substituted through phosphorus such as that of phosphonyl or the like.

The above-mentioned substituents typically include, for example, a methyl, ethyl, isopropyl, t-butyl, pentadecyl, heptadecyl, 1-hexylnonyl, 1,1'-dipentylnonyl, 2-chloro-t-butyl, trifluoromethyl, 1-ethoxytridecyl, 1-methoxyisopropyl, methanesulfonylethyl, 2,4-di-t-amylphenoxymethyl, anilino, 1-phenylisopropyl, 3-m-butanesulfonaminophenoxypropyl, 3-4'-{α-[4''(p-hydroxybenzenesulfonyl) phenoxy]dodecanoylamino}-phenylpropyl, 3-{4'-[α-(2'', 4''-di-t-amylphenoxy) butaneamido]-phenyl}-propyl. 4-[α-(o-chlorophenoxy)-tetradecaneamidophenoxy]-propyl, allyl, cyclopentyl, or cyclohexyl group.

The aryl groups represented by R preferably include, for example, a phenyl group, and they are allowed to have such a substituent as an alkyl, alkoxy or acylamino group. They typically include, for example, a phenyl, 4-t-butylphenyl, 2,4-di-t-amylphenyl, 4-tetradecaneamidophenyl, hexadesiloxy phenyl, or 4'-[α-(4''-t-butylphenoxy)tetradecaneamido]phenyl group.

The heterocylic groups represented by R preferably include, for example, the 5 to 7 membered ones. They are allowed to be substituted or condensed, and they typically include, for example, a 2-furyl, 2-thienyl, 2-pyrimidinyl, or 2-benzothiazolyl group.

The acyl groups represented by R include, for example, an alkylcarbonyl group such as an acetyl, phenylacetyl, dodecanoyl, α-2,4-di-t-amylphenoxybutanoyl group and the like; and, an arylcarbonyl group such as a benzoyl, 3-pentadecyloxy benzoyl, p-chlorobenoyl group, and the like.

The sulfonyl groups represented by R include, for example, alkylsulfonyl group such as methylsulfonyl and dodecylsulfonyl groups, an arylsulfonyl group such as benzenesulfonyl and p-totuenesulfonyl groups.

The sulfinyl groups represented by R include, for example, an alkylsulfinyl group such as an ethylsulfinyl, octylsulfinyl or 3-phenoxybutylsulfinyl group; an arylsulfinyl group such as a phenylsulfinyl or m-pentadecylphenylsulfinyl group.

The phosphonyl groups represented by R include, for example, an alkylphosphonyl group such as butyloctylphosphonyl group, an alkoxyphosphonyl group such as octyloxyphosphonyl group, an aryloxyphosphonyl group such as phenoxyphosphonyl group, an arylphosphonyl group such as phenylphosphonyl group, and the like.

In the carbamoyl groups represented by R, the alkyl, aryl and more preferably phenyl groups thereof may be substituted. They include, for example, N-methylcarbamoyl group, N,N-dibutylcarbamoyl group, N-(2-pentadecyloctylethyl) carbamoyl group, N-ethyl-N-dodecylcarbamoyl group, N-{3-(2,4di-t-amyl-phenoxy)propyl}carbamoyl group, and the like.

In the sulfamoyl groups represented by R, the alkyl, aryl and more preferably phenyl groups may be substituted. They include, for example, N-propylsulfamoyl group, N,N-diethylsulfamoyl group, N-(2-pentadecyloxyethyl)sulfamoyl group, N-ethyl-N-dodecylsulfamoyl group, N-phenylsulfamoyl group, and the like.

The spiro compound residual groups represented by R include, for example, spiro[3.3]heptane-1-yl, and the like.

The bridged hydrocarbon compound residual groups include, for example, bicyclo[2.2.1]heptane-1-yl, tricyclo [3.3.1.1$^{3,7}$]-decane-1-yl, 7,7-dimethyl-bicyclo[2.2.1-]heptane-l-yl and the like.

The alkoxy groups represented by R are allowed to substitute the substituents given to the above-mentioned alkyl groups, and they include, for example, a methoxy, propoxy, 2-ethoxyethoxy, pentadecyloxy, 2-dodecyloxyethoxy, phenethyloxyethoxy and the like groups.

The aryloxy groups represented by R preferably include, for example, a phenyloxy group, and the aryl nucleus thereof is further allowed to be substituted by the substituents or atoms given to the above-mentioned aryl groups. They include, for example, a phenoxy, p-t-butylphenoxy, m-pentadecylphenoxy and the like groups.

The heterocyclicoxy groups represented by R preferably include, for example, those each having a 5 to 7 membered heterocylic ring which is also allowed to have a substituent. They include, for example, a 3,4,5,6-tetrahydorpyranyl-2-oxy group and a 1-phenyltetrazole-5-oxy group.

The siloxy groups represented by R may further be substituted by an alkyl group or the like. They include, for example, a trimethylsiloxy, triethylsiloxy, dimethylbutylsiloxy and the like groups.

The acyloxy groups represented by R include, for example, an alkylcarbonyloxy, arylcarbonyloxy and the like groups. They are further allowed to have a substituent including, typically, an acetyloxy, α-chloracetyloxy, benzoyloxy and the like groups.

carbamoyloxy groups represented by R may be substituted by an alkyl, aryl or the like group. They include, for example, N-ethylcarbamoyloxy, N,N-diethylcarbamoyloxy, N-phenylcarbamoyloxy and the like group.

The amino groups represented by R may also be substituted by an alkyl group, an aryl group and more preferably a phenyl group, and the like group. They include, for example, an ethylamino, anilino, m-chloranilino, 3-pentadecyloxycarbonylanilino, 2-chloro-5-hexadecaneamidoanilino and the like groups.

The acylamino groups represented by R include, for example, an alkylcarbonylamino, arylcarbonylamino and more preferably phenylcarbonylamino, and the like groups. They may further have a substituent including, typically, an acetamido, α-ethylpropaneamido, N-phenylacetamido, dodecaneamido, 2,4-di-t-amylphenoxyacetamido, α-3-t-butyl-4-hydroxyphenoxybutaneamido and the like groups.

The supfonamido groups represented by R include, for example, an alkylsulfonylamino, arysulfonylamino and the like groups, and they are allowed to have a substituent including, typically, a methylsulfonylamino, pentadecysulfonylamino, benzenesulfonamido, p-tolunenesulfonamido, 2-methoxy-5-t-amyl-benzenesulfonamido and the like groups.

The imido groups represented by R may be of the open-chained or of the cyclic, and they may also have a substituent including, for example, a succinic acid imido, 3-heptadecyl succinic acid imido, phthalic imido, glutaric imido and the like groups.

The ureido groups represented by R may be substituted by an alkyl, aryl and preferably phenyl or the like group. They include, for example, N-ethylureido, N-methyl-N-decylureido, N-pheylureido, N-p-tolylureido and the like groups.

The sulfamoylamino groups represented by R may be substituted by an alkyl, aryl and more preferably phenyl, or the like group. They include, for example, a N,N-dibutyl-sulfamoylamino, N-methylsulfamoylamino, N-phenylsufamoylamino and the like groups.

The alkoxycarbonylamino groups represented by R may further have a substituent including, for example, a methoxycarbonylamino, methoxyethoxycarbonylamino, octadecyloxycarbonylamino and the like groups.

The aryloxycarbonylamino groups represented by R may have a substituent including, for example, a phenoxycarbonylamino, 4-methylphenoxycarbonylamino and the like groups.

The alkoxycarbonyl groups represented by R may further have a substituent including, for example, a methoxycarbonyl, butyloxcarbonyl, dodecyloxycarbonyl, octadecyloxycarbonyl, ethoxymethoxycarbonyloxy, benzyloxycarbonyl and the like groups.

The aryloxycarbonyl groups represented by R may further have a substituent including, for example, a phenoxycarbonyl, p-chlorophenoxycarbonyl, m-pentadecyloxyphenoxycarbonyl and the like groups.

The alkythio groups represented by R may further have a substituent including, for example, an ethylthio, dodecylthio, octadecylthio, phenethylthio and 3-phenoxypropylthio groups.

The arylthio groups represented by R include preferably a phenylthio group and may further have a substituent including, for example, a phenylthio, p-methoxyphenylthio, 2-t-octylphenylthio, 3-oxtadecylphenythio, 2-carboxyphenylthio, p-acetaminophenylthio and the like groups.

The heterocyclicthio groups represented by R include, preferably, a 5 to 7 membered heterocyclicthio group, and may further have a condensed ring or a substituent. They include, for example, a 2-pyridylthio, 2-benzothiazolythio, and 2,4-diphenoxy-1,3,5-triazole-6-thio groups.

The substituents represented by X which are capable of splitting off through the reaction thereof to the oxidation products of a color developing agent include, for example, the groups substituted through carbon, oxygen, sulphur or nitrogen atom as well as such a halogen atom as chlorine, bromine, fluorine or the like atom.

The groups substituted through a carbon atom include, for example, a carboxyl group and besides, the groups represented by the following formula:

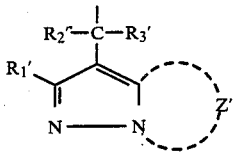

wherein $R_1'$ is synonymous with the above-mentioned R; Z' is synonymous with the above-mentioned Z; and $R_2'$ and $R_3'$ represented hydrogen, an aryl group, an alkyl group or a heterocyclic group, respectively; a hydroxymethyl group and a triphenylmethyl group.

The groups substituted through oxygen include, for example, an alkoxy, aryloxy, heterocyclicoxy, acyloxy, sulfonyloxy, alkoxycarbonyloxy, aryloxycarbonyloxy, alkyloxalyloxy and alkoxyoxalyloxy groups.

The alkoxy groups are allowed to have a substituent including, for example, an ethoxy, 2-phenoxyethoxy, 2-cyanoethoxy, phenethyloxy, p-chlorobenzyloxy and the like groups.

Among the aryloxy groups, a phenoxy group is preferred. Such aryloxy groups may have a substituent. They include typically phenoxy, 3-methylphenoxy, 3-dodexylphenoxy, 4-methanesulfonamidophenoxy, 4-[α-(3'-pentadecylphenoxy) butnamido]phenoxy, hexyldecylcarbamoylmethoxy, 4cyanophenoxy, 4-methanesulfonylphenoxy, 1-naphthyloxy, p-methoxyphenoxy and the like groups.

The heterocyclicoxy groups include preferably a 5 to 7 membered heterocyclicoxy group. and may be condensed or substituted. They typically include a 1-phenyltetrazolyloxy, 2-benzothiazolyloxy or the like group.

The acyloxy groups include, for example, such an alkylcarbonyloxy group as an acetoxy, butanoloxy or the like group; such an alkenylcarbonyloxy group as a cinnamoyloxy group; and such an arylcarbonyloxy group as a benzoyloxy group.

The sulfonyloxy groups include, for example, a butanesulfonyloxy group or a methanesulfonyloxy group.

The alkoxycarbonyloxy groups include, for example, an ethoxycarbonyloxy group or a benzloxycarbonyloxy group.

The aryloxycarbonyl groups include, for example, a phenoxycarbonyloxy group or the like groups.

The alkyloxalyloxy groups include, for example, a methyloxaloxy group.

The alkoxyoxalyloxy groups include, for example, an ethoxyoxalyoxy groups include, for example, an ethoxyoxalyloxy group and the like.

The groups substituting through sulphur include, for example, an alkylthio, arylthio, heterocyclicthio, alkyolxythiocarbonylthio or the like groups.

The alkylthio groups include, for example, a butylthio, 2-cyanoethylthio, phenethylthio, benzlthio or the like groups.

The arylthio groups include, for example, a phenylthio, 4-methanesulfonamidophenllthio, 4-dodecylphenethylthio, 2-nonafluoropentanamidophenethythio, 4-carboxyphenylthio, 2-ethoxy-5-t-butylphenylthio or the like groups.

The heterocyclicthio groups include, for example, a 1-phenyl-1,2,3,4-tetrazolyl-5-thio, 2-benzothiazolythio or the like groups.

The alkyloxythiocarbonylthio groups include, for example, a dodecyloxythiocarbonylthio or the like groups.

The groups sustituting through the above-mentioned nitrogen include, for example, those represented by the following formula:

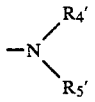

wherein, $R_4'$ and $R_5'$ represent a hydrogen atom, an alkyl, aryl, heterocyclic, sulfoamoyl, carbamoyl, acyl, sulfonyl, aryloxycarbonyl or alkoxycarbonyl group; and $R_4'$ and $R_5'$ may be so coupled each other as to form a heterocyclic ring, provided that $R_4'$ and $R_5'$ shall not be hydrogen at the same time.

The alkyl groups are allowed to be normal-chained or branch-chained and peferably have 1 to 22 carbon atoms. The alkyl groups may have such substituent as an aryl, alkoxy, aryloxy, alkylthio, arylthio, alkylamino, arylamino, acylamino, sulfonamido, imino, acyl, alkysulfonyl, arysulfonyl, carbamoyl, sulfamoyl, alkoxycarbonyl, aryloxycarbonyl, alkyloxycarbonylamino, aryloxycarbonylamino, hydroxyl, carboxyl and cyano groups and a halogen. As for the typical examples of the alkyl groups, ehtyl, octhyl, 2-ethylhexyl and 2-chlorethyl groups may be given.

It is preferred that the acry groups represented by $R_4'$ and $R_5'$ have 6 to 32 carbon atoms and that they are a phenyl or NAPHTHYL group in particular. They are also allowed to have substituents including, for example, the substituents to the alkyl groups represented by the above-mentioned $R_4'$ and $R_5'$, and an alkyl group. The typical examples of the aryl groups include a phenyl, 1-naphthyl or 4-methylsulfonyphenyl group.

It is preferred that the heterocyclic groups represented by the above-mentioned $R_4'$ and $R_5'$ are the 5 to 6 membered ones. They are also allowed to be of the condensed ring and to have a substituent. The typical examples thereof include a 2-furyl, 2-quinolyl, 2-pyrimidyl, 2-benzothiazolyl, 2-pyridyl or the like group.

The sulfamoyl groups represented by the $R_4'$ and $R_5'$ include, for example, N-alkylsulfamoyl, N,N-dialkylsulfamoyl, N-arylsulfamoyl, N,N-diarylsulfamoyl and the like groups. These alkyl and aryl groups are allowed to have the same substituents as those given in the cases of the above-mentioned alkyl and aryl goups. The typical examples of the sulfamoyl groups include N,N-diethylsulfamoyl, N-methylsulfamoyl, N-dodecylsulfamoyl and N-p-tolylsulfamoyl groups.

The carbamoyl groups represented by the $R_4'$ and $R_5'$ include, for example, N-alkylcarbamoyl, N,N-dialkylcarbamoyl, N-arylcarbamoyl, N,N-diarylcarbamoyl and the like groups. These alkyl and aryl groups are allowed to have the same substituents as those given in the cases of the above-mentioned alkyl and aryl groups. The typical examples of the carbamoyl groups include N,N-diethylcarbamoyl, N-methylcarbamoyl, N-dodecylcarbamoyl, N-p-cyanophenylcarbamoyl and N-p-tolyl-carbamoyl groups.

The acyl groups represented by the $R_4'$ and $R_5'$ include, for example, alkylcarbonyl, arylcarbonyl and heterocyclic carbonyl groups. Such alkyl, aryl and heterocyclic groups are allowed to have a substituent. The typical examples of the acyl groups include a hexafluorobutanoyl, 2,3,4,5,6-penta-fluorobenzoyl, acetyl, benzoyl, naphthoyl, 2furylcarbonyl or the like groups.

The sulfonyl groups represented by the $R_4'$ and $R_5'$ include, for example, an alkylsulfonyl, arysulfonyl or heterocyclic sulfonyl group, and they are also allowed to have a substituent. The typical examples of these sulfonyl groups include an ethanesulfonyl, benzensulfonyl, octanesulfonyl, naphthalenesulfonyl, p-chlorobenzenesulfonyl or the like groups.

The aryloxycarbonyl groups represented by the $R_4'$ and $R_5'$ are allowed to have the same substituents as those given in the case of the above-mentioned aryl groups. The typical examples thereof include a phenoxycarbonyl group and the like.

The alkoxycarbonyl groups represented by the $R_4'$ and $R_5'$ are allowed to have the same substituents as those given in the case of the above-mentioned alkyl groups. The typical examples thereof include a methoxycarbonyl, dodecylocarbonyl, benzyloxycarbonyl or the like groups.

It is preferred that the above-mentioned heterocyclic rings formed by coupling $R_4'$ and $R_5'$ thereto are the 5 to 6 membered ones. They may be saturated or unsaturated and of the aromatic or the non-aromatic and further condensed rings. Such heterocylic rings include, for example, N-phthalimido, N-succinic acid imido, 4-N-urazolyl, 1-N-hydantoinyl, 3-N-2,4-dioxooxazolidinyl, 2-N-1,1-dioxo-3-(2H)-oxo-1,2-benzothiazolyl, 1-pyrrolyl, 1-pyrrolidinyl, 1-pyrazolyl, 1-pyrazolidinyl, 1-piperidinyl, 1-imidazolyl, 1-imidazolinyl, 1-indolyl, 1-isoindolinyl, 2-isoindolyl, 2-isoindolinyl, 1benzotraizolyl, 1-benzoimidazolyl, 1-(1,2,4-triazolyl), 1-(1,2,3-triazolyl), 1-(1,2,3,4-tetrazolyl), N-morpholinyl, 1,2,3,4-tetrahydroquinolyl, 2-oxo-1-pyrrolidinyl, 2-1H-pyridone, phthaladione, 2-oxo-1-piperidinyl and the like groups. These heterocyclic groups may also be substituted by an alkyl, aryl, alkyloxy, aryloxy, acyl, sulfonyl, alkylamino, arylamino, acylamino, sulfonamino, carbamoyl, sulfamoyl, alkylthio, arylthio, ureido, alkoxycarbonyl, aryloxycarbonyl, imido, nitro, cyano, carboxyl or the like groups, a halogen or the like.

The nitrogen-containing heterocyclic rings formed by the above-mentioned Z or Z' include, for example, a pyrazole, imidazole, traizole, tetrazole or the like ring. The substituents which the above-mentioned rings are allowed to have include, for example, the same substituents as those given with respect to the above-mentioned R.

In the case that such a substituent as R or one of from $R_1$ to $R_8$ on a heterocyclic ring shown in Formula [I] and Formulae [II] to [VIII] of which will be described later has the following part;

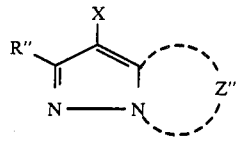

(wherein, R'', X and Z'' are synonymous with R, X and Z in Formula [I], a so-called bis-type coupler is formed, and it is a matter of course that such couplers shall be included in the invention. Further, in a ring formed by the Z, Z', Z'' or $Z_1$ that is to be described later, it is also allowed that another ring such as a 5 to 7 membered cycloalkene may be condensed. For example, it is allowed to form a ring such as a 5 to 7 membered cycloalkene or benzene by coupling $R_5$ and $R_6$ to each other in Formula [V] and by coupling $R_7$ and $R_8$ to each other in Formula [VI].

The magenta couplers represented by Formula [I] may further typically be represented by the following formulae [II] to [VII]:

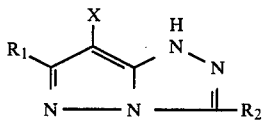

Formula [II]

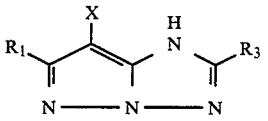

Formula [III]

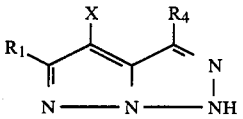

Formula [IV]

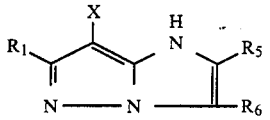

Formula [V]

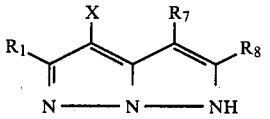

Formula [VI]

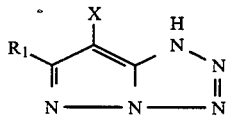

Formula [VII]

In the abovegiven Formulae [II] to [VII], $R_1$ to $R_8$ and X are synonymous with the aforementioned R and X, respectively.

The couplers represented by the following Formula [VIII] are the preferred ones among those represented by the Formula [I];

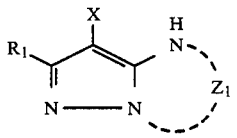

Formula [VIII]

wherein $R_1$, X and $Z_1$ are synonymous with R, X and Z denoted in the Formula [I].

The particularly preferred magenta couplers among those represented by the abovegiven Formulae [II] to [VII] are the magenta couplers represented by Formula [II].

A substituent on the heterocyclic rings in the Formulae [I] to [VIII] becomes a preferred one, provided that R in Formula [I] or $R_1$ in Formulae [II] to [VIII] satisfies the following requirement 1. It becomes a further preferred one, provided that the R or $R_1$ satisfies the following requirements 1 to 2. It becomes a particularly preferred one, provided that the R or $R_1$ satisfies the following requirements 1, 2 and 3:

Requirement 1: An atom directly coupled to a heterocyclic ring is a carbon atom.

Only one hydrogen atom couples to the carbon atom, or nothing couples thereto.

Requirement 3: Every coupling of the carbon atom to the neighboring atoms is a single coupling.

The most preferred substituents R and $R_1$ on the above-mentioned heterocyclic rings are represented by the following Formula [IX];

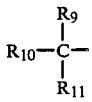

Formula [IX]

wherein $R_9$, $R_{10}$ and $R_{11}$ represent, respectively, a hydrogen atom, a halogen atom, an alkyl group, cycloalkyl group, alkenyl group, cycloalkenyl group, alkynyl group, aryl group, heterocyclic group, sulfonyl group, sulfinyl group, phosphonyl group, carbamoyl group, sulfamoyl group, cyano group, spiro compound residual group,bridged hydrocarbon compound residual group, alkoxy group, aryloxy group, heterocyclicoxy group, siloxy group, acyloxy group, carbanoyloxy group, amino group, acylamino group, sulfonamido group, imido group, ureido group, sulfamoylamino group, alkoxycarbonylamino group, aryloxycarbonylamino group, alkoxycarbonyl group, aryloxycarbonyl group, alkylthio group, arylthio group or heterocyclicthio group; and at least two of the $R_9$, $R_{10}$ and $R_{11}$ are not hydrogen atom.

Two out of the above-mentioned $R_9$, $R_{10}$ and $R_{11}$ which are, for example, $R_9$ and $R_{10}$ are allowed to couple to each other so as to form a saturated or unsaturated ring such as a cycloalkane, cycloalkene or heterocyclic ring, or so as further to produce a bridged hydrocarbon compound residual group by coupling $R_{11}$ to the above-mentioned ring.

The groups represented by $R_9$ to $R_{11}$ are allowed to have a substituent. The typical examples of both the groups represented by $R_9$ to $R_{11}$ and substituents which the above-mentioned groups are allowed to have include the typical examples of the groups represented by R denoted in the above-given Formula [I] and the substituents thereto.

The typical examples of both the rings formed by coupling, for example, $R_9$ to $R_{10}$ to each other and the bridged hydrocarbon compounds formed by $R_9$ to $R_{11}$, and the examples of the substituents which the groups represented by $R_9$ to $R_{11}$ are allowed to have include the typical examples of a cycloalkyl group, a cycloalkenyl group, a heterocyclic group and a bridged hydrocarbon compound residual group each represented by R denoted in the aforegiven Formula [I] and the substituents thereto.

The following two cases are preferred with respect to the Formula [IX]:

(i) A case that two of $R_9$ through $R_{11}$ are alkyl groups, and (ii) Another case that one of the $R_9$ through $R_{11}$ is a hydrogen atom and, $R_{10}$ and $R_{11}$ are coupled to each other so as to form a cycloalkyl group, together with the carbon atom.

Further, in the case (i), the preferrable case is that two of the $R_9$ through $R_{11}$ are alkyl groups and the rest is either hydrogen or an alkyl group.

The above-mentioned alkyl and cycloalkyl groups are allowed to have a substituent. The typical examples of the alkyl groups, the cycloalkyl groups and the substituents include the typical examples of the alkyl groups, the cycloalky groups and the substituents represented by R denoted in the aforegiven Formula [I].

For serving as the substituents which both of the rings formed by Z denoted in Formula [I] and those formed by $Z_1$ denoted in Formula [VIII] are allowed to have, and as $R_2$ through $R_8$ denoted in Formulae [II] through [VI], the preferred ones are represented by the following Formula [X];

$$-R^1-SO_2-R^2$$

Formula [X]

wherein $R^1$ represents an alkylene group; and $R^2$ represents an alkyl, cycloalkyl or aryl group.

The alkylene group represented by $R^1$ is to have preferably not less than 2 carbon atoms and more preferably 3 to 6 carbon atoms in the normal chained portion thereof, regardless of the normal or branch chained. The alkylene group may also have a substituent.

The examples of the above-mentioned substituents include those which an alkyl group may have provided that the alkyl group is represented by R denoted in the aforegiven Formula [I].

The preferred substituents include, for example, a phenyl group.

The typical and preferable examples of the alkylene groups represented by $R^1$ are given below:

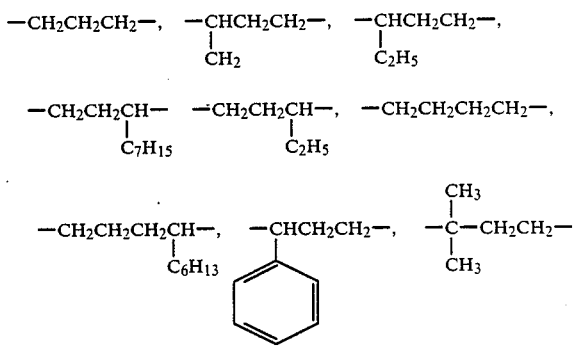

It is regardless of that the alkyl groups represented by $R^2$ are normal chained or branch chained.

The above-mentioned alkyl groups typically include a methyl, ethyl, propyl, isopropyl, butyl, 2-ethylhexyl, octyl, dodecyl, tetradecyl, hexadecyl, octadecyl, 2-hexyldecyl or the like group.

The cycloalkyl groups represented by $R^2$ preferably include a 5 to 6 membered one that is, for example, a cyclohexyl group.

The alkyl and cycloalkyl groups each represented by $R^2$ are allowed to have a substituent which includes, for example, the substituents to the above-mentioned $R^1$.

The typical examples of the aryl groups represented by $R^2$ include, for example, a phenyl group and a naphthyl group. The aryl groups are allowed to have a substituent. These substituents include, for example, a normal chained or branch-chained alkyl group and, besides, the substituents exemplified as those to the above-mentioned $R^1$.

When there are not less than two substituents, such substituents may be the same with or the different from each other.

The particularly preferable compounds among those represented by Formula [I] are represented by the following Formula [XI];

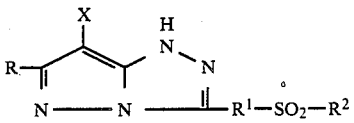

Formula [XI]

wherein R and X are synonymous with R and X denoted in Formula [I]; and $R^1$ and $R^2$ are synonymous with $R^1$ and $R^2$ denoted in Formula [X].

The typical examples of the coupler of the invention will be given below, but the invention is not limited thereto.

1

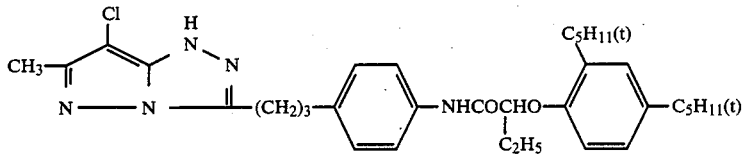

2

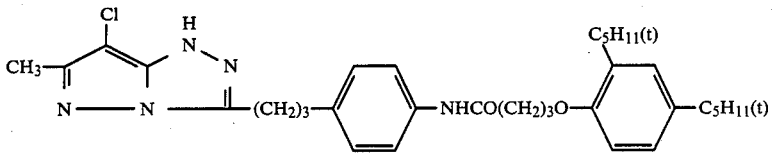

3

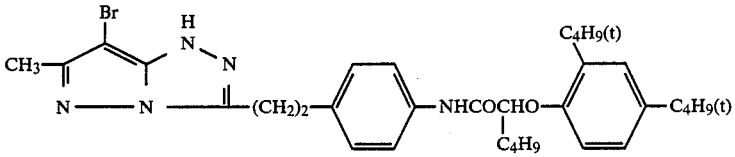

4

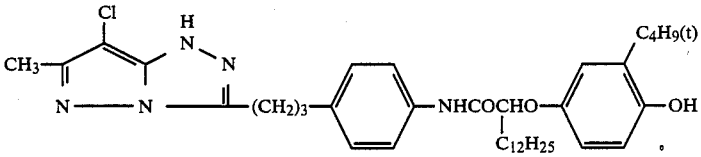

5

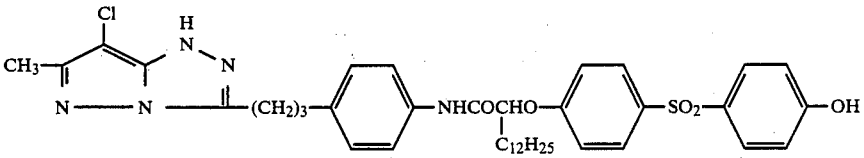

6

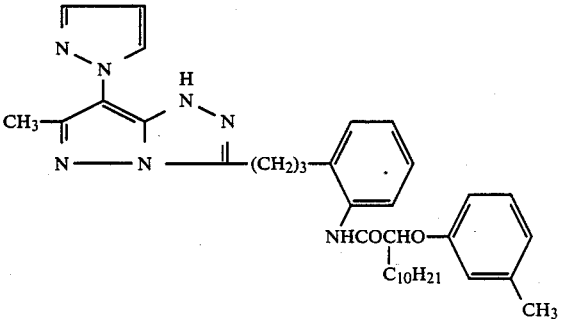

-continued
7
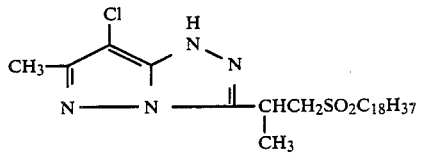
8
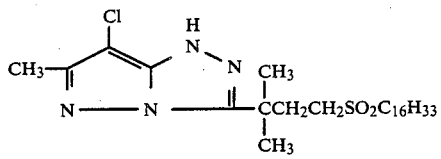
9
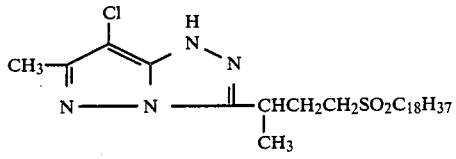
10
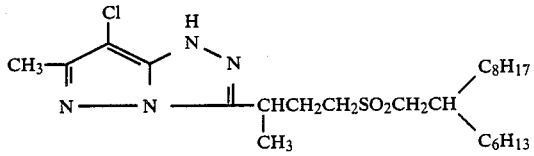
11
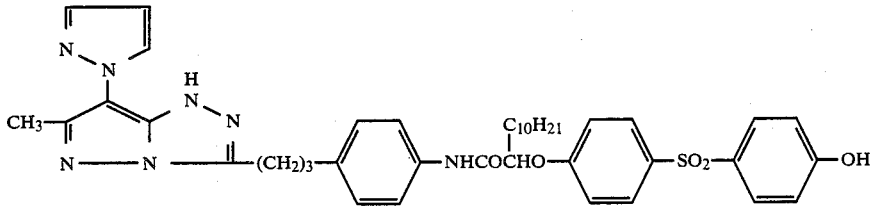
12
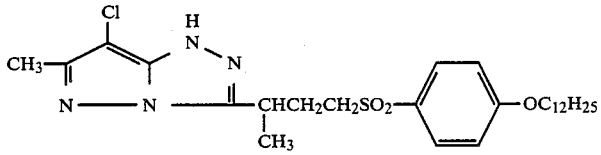
13
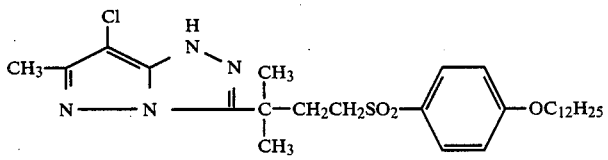
14
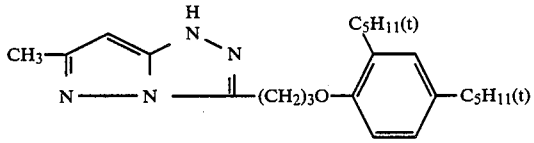
15
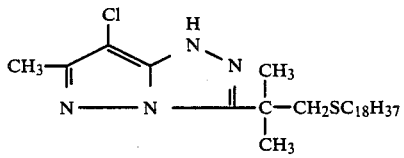

-continued
16
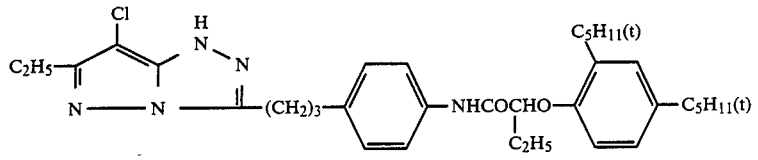
17
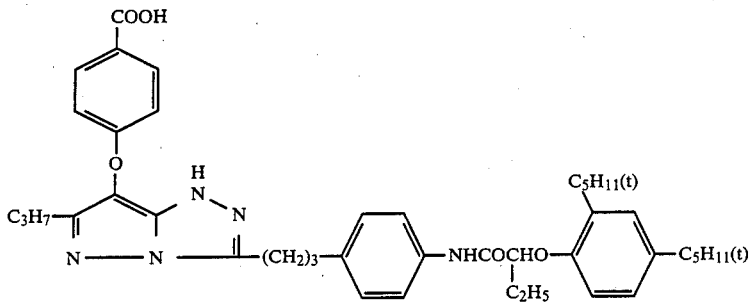
18
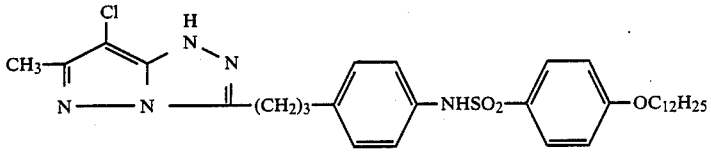
19
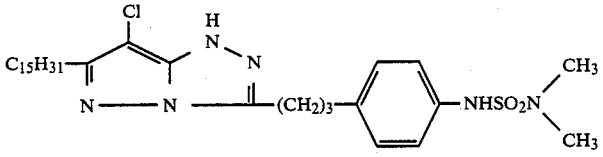
20
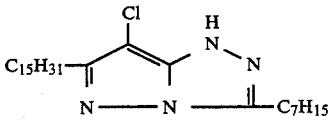
21
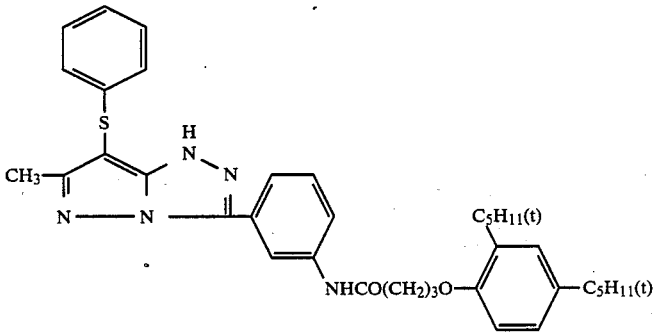
22
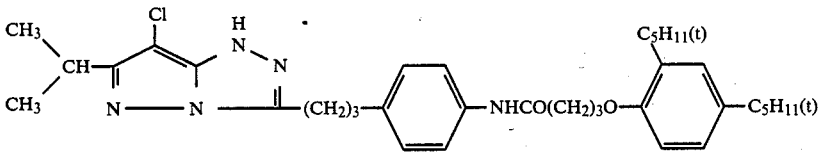
23
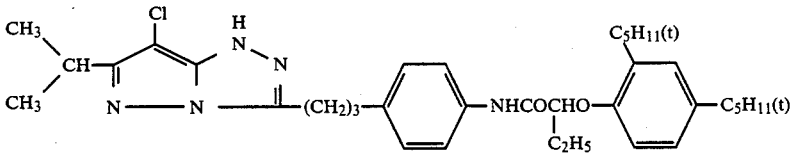

-continued
24
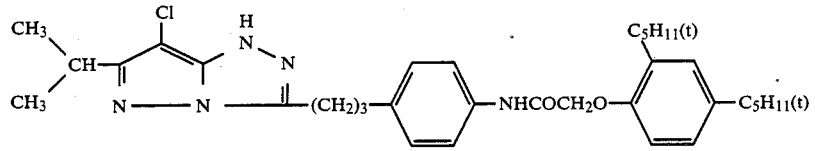
25
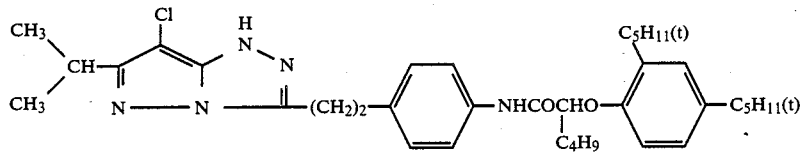
26
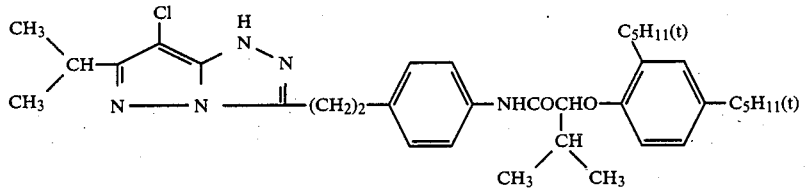
27
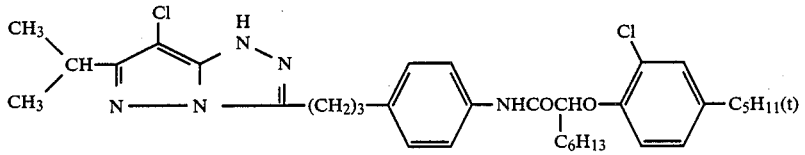
28
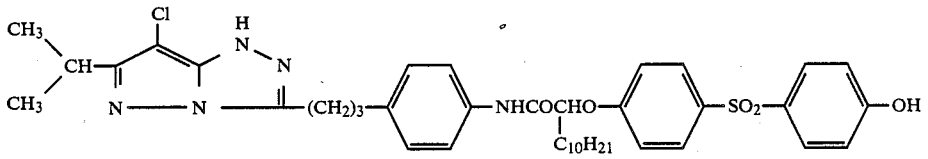
29
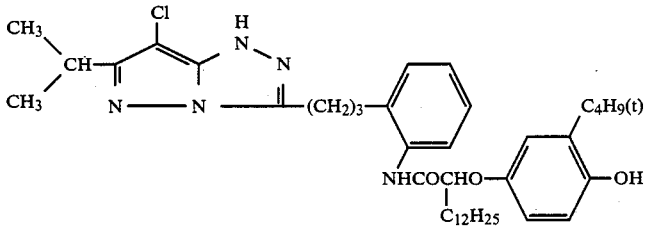
30
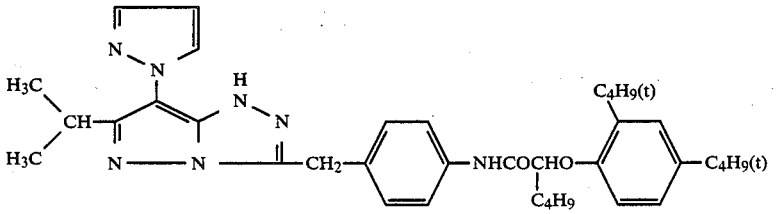
31
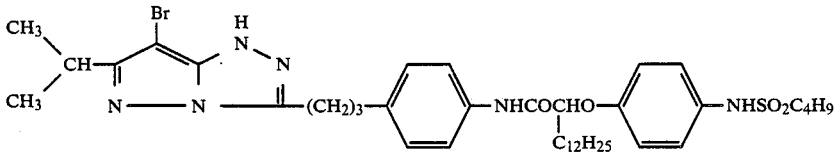
32
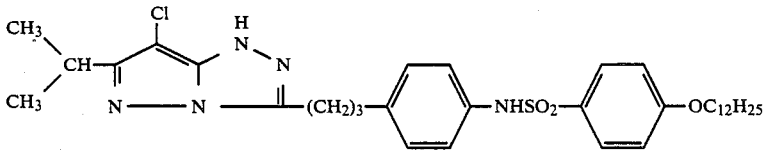

-continued
33
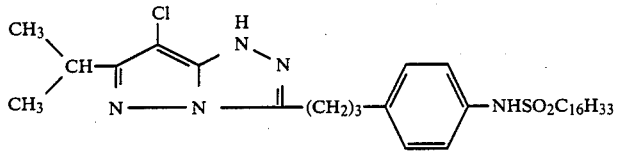
34
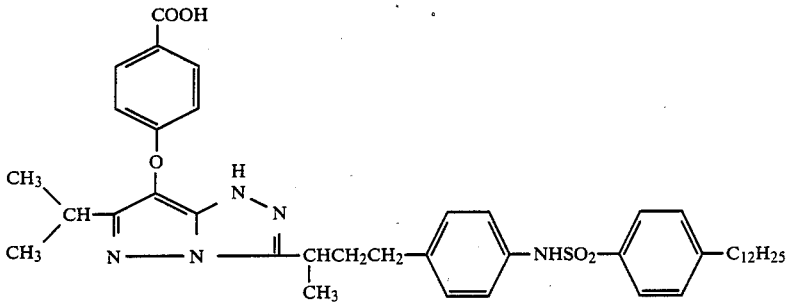
35
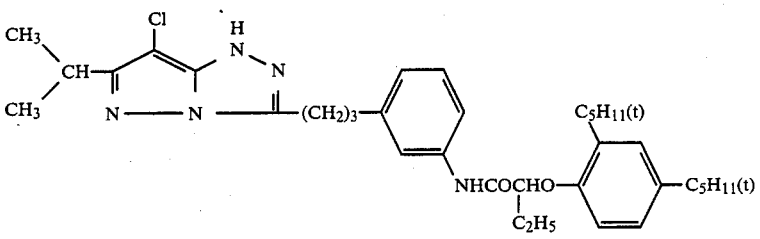
36
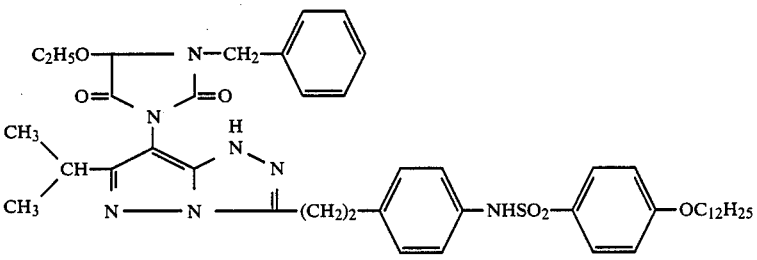
37
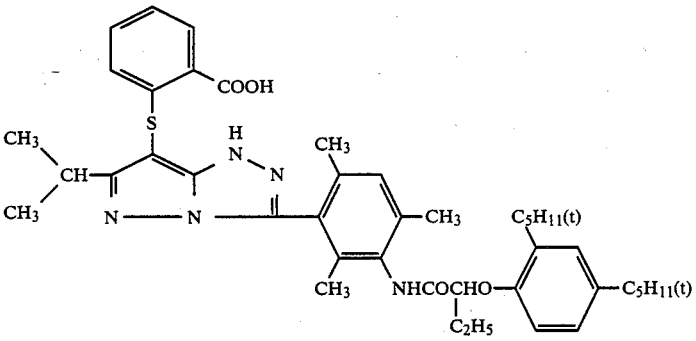
38
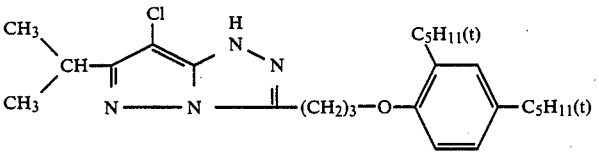

-continued
39
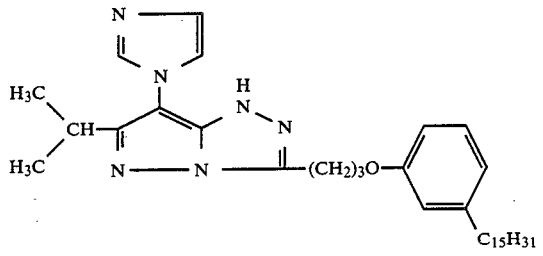
40
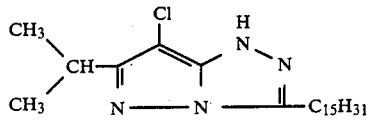
41
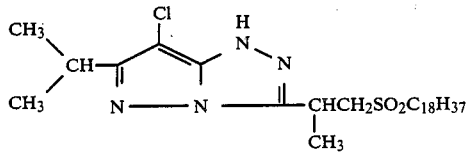
42
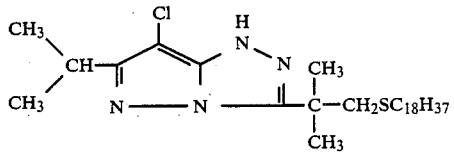
43
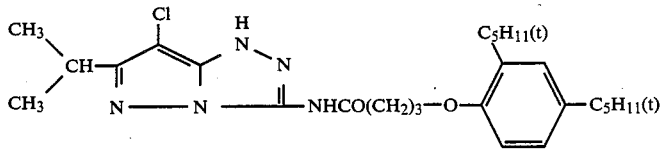
44
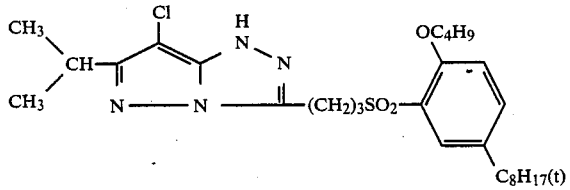
45
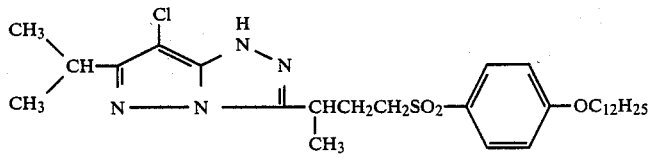
46
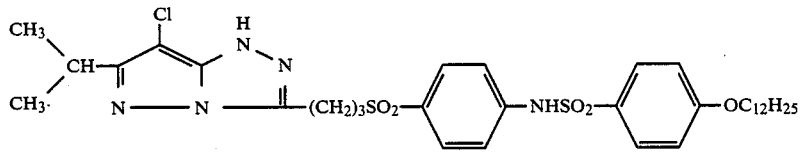
47
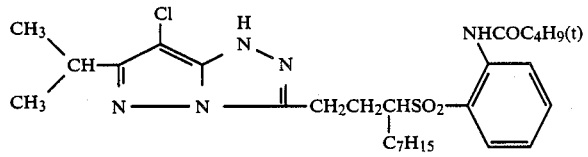

-continued
48
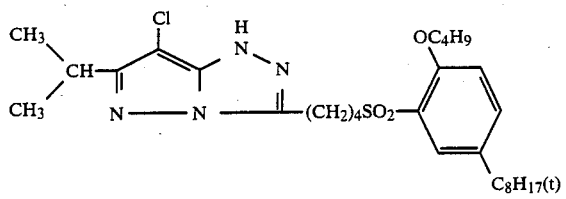
49
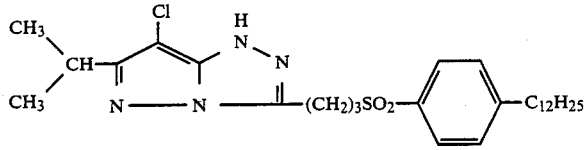
50
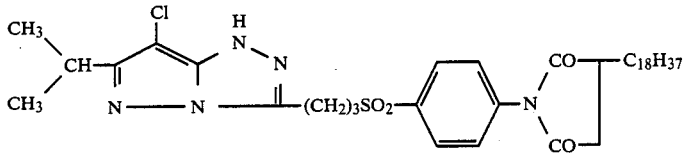
51
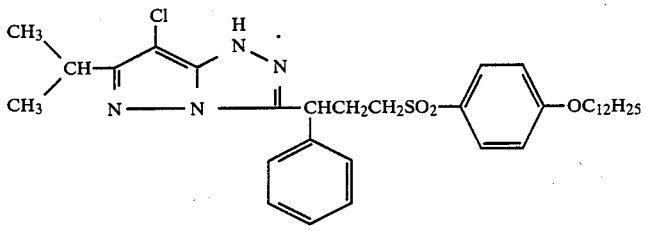
52
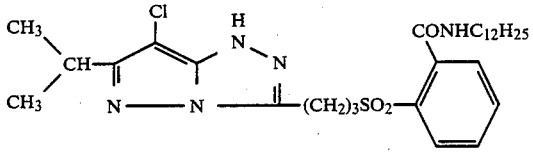
53
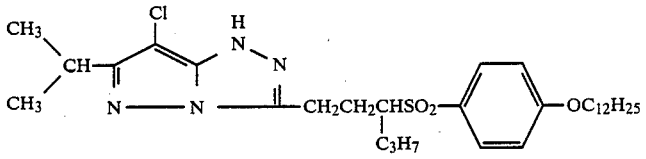
54
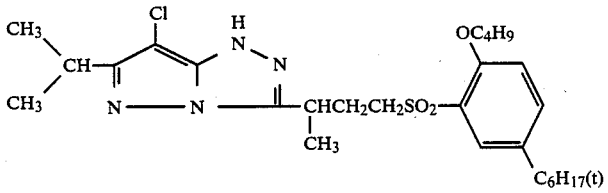
55
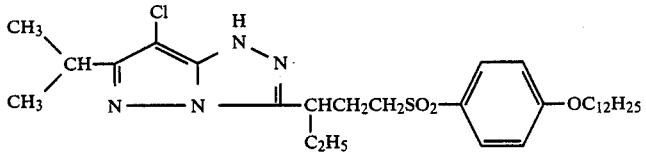
56
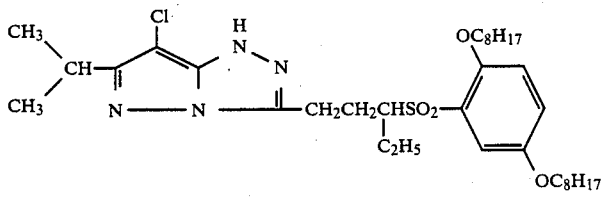

-continued
57
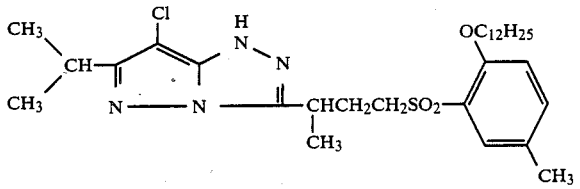
58
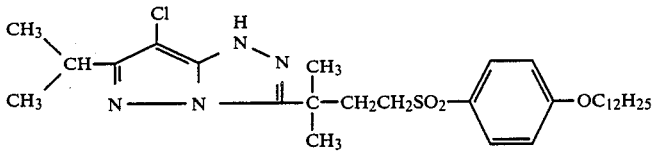
59
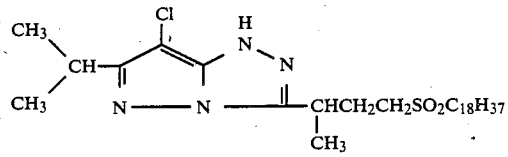
60
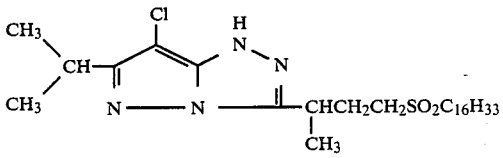
61
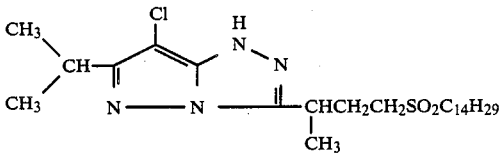
62
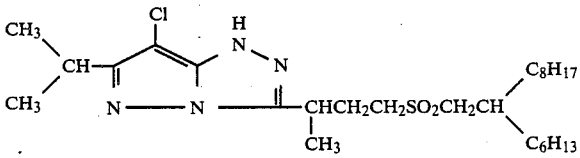
63
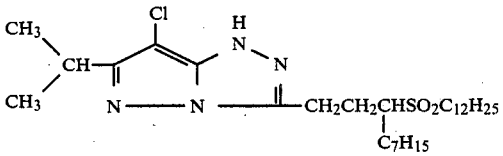
64
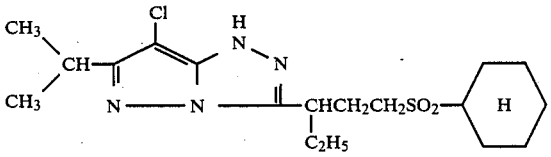
65
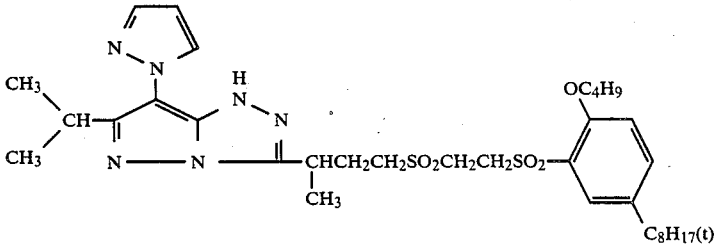

-continued
66
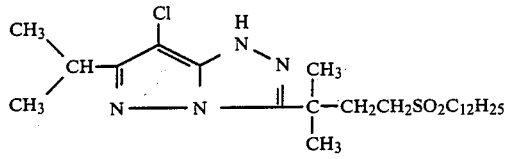
67
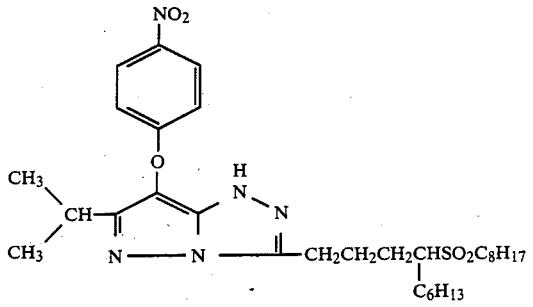
68
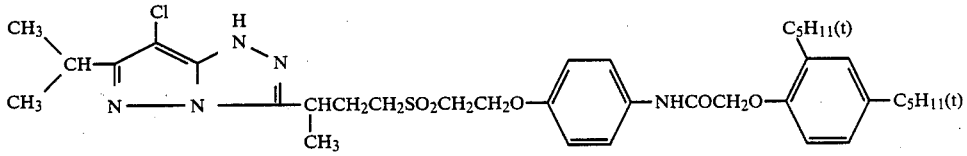
69
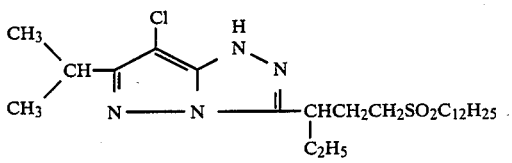
70
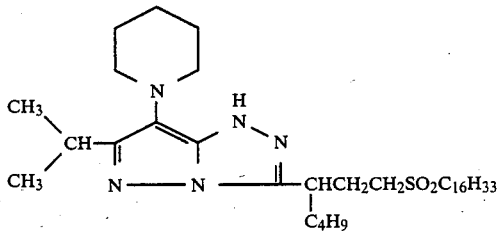
71
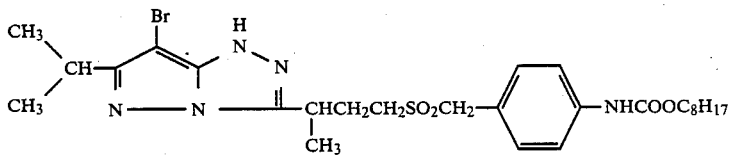
72
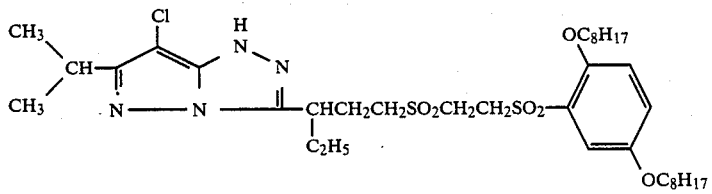

-continued
73
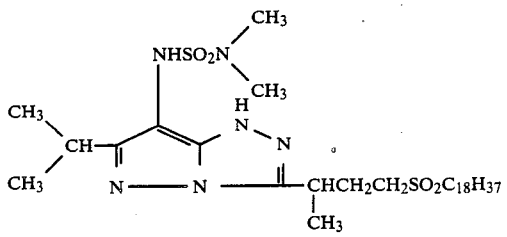
74
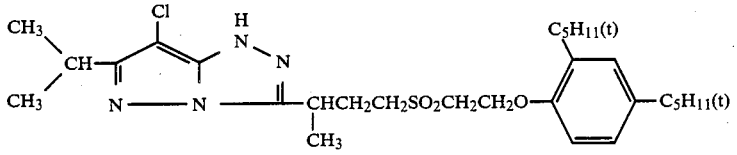
75
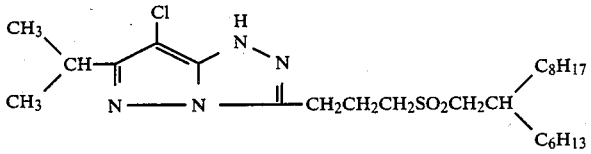
76
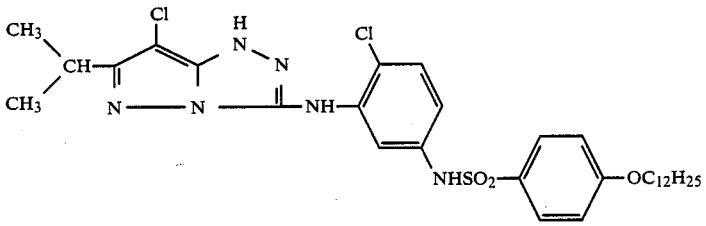
77
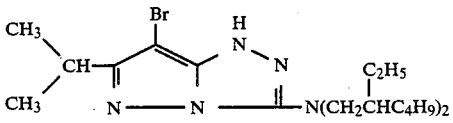
78
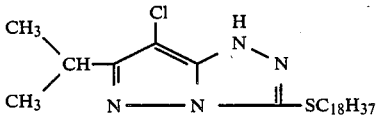
79
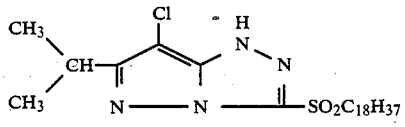
80
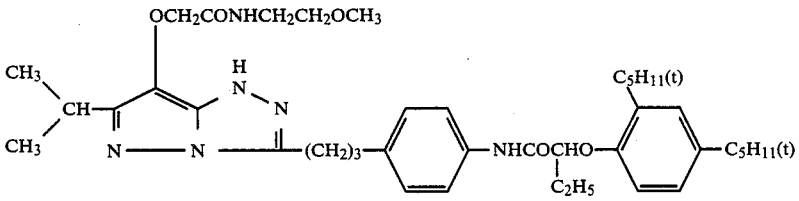
81
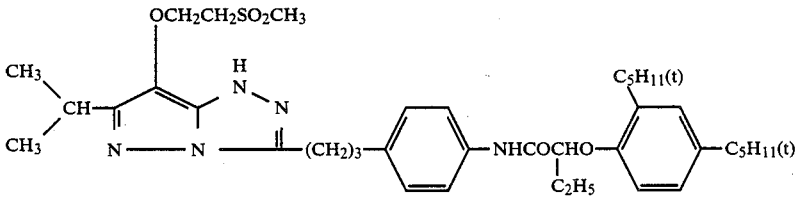

-continued
82
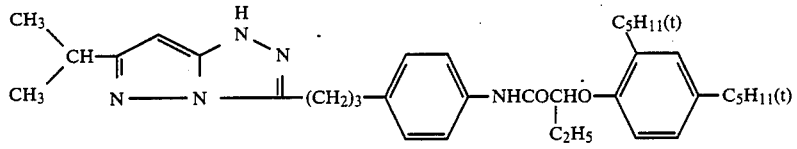
83
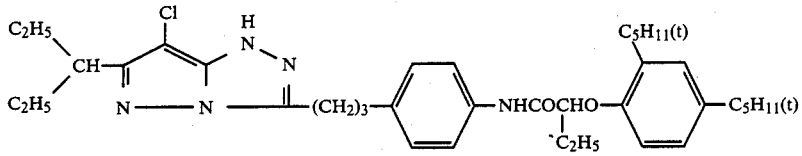
84
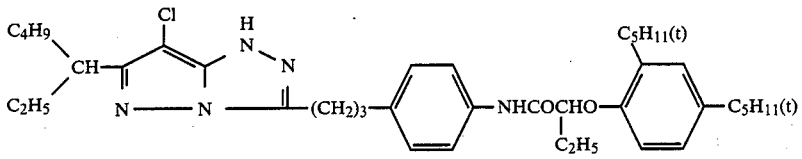
85
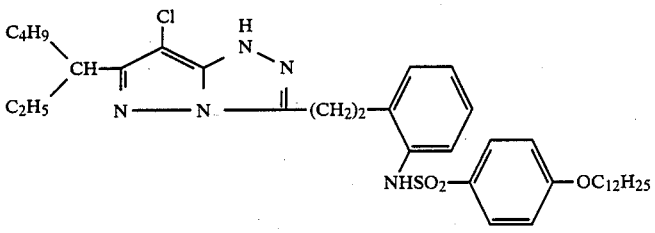
86
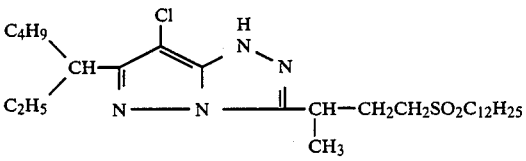
87
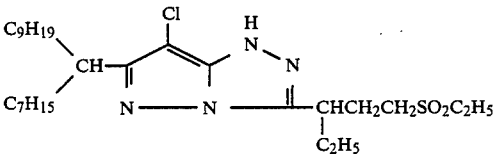
88
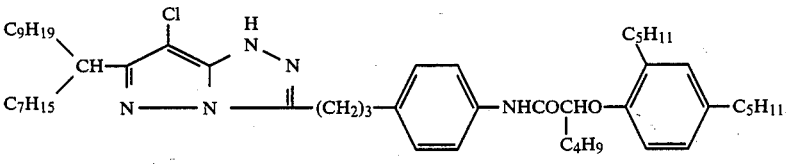
89
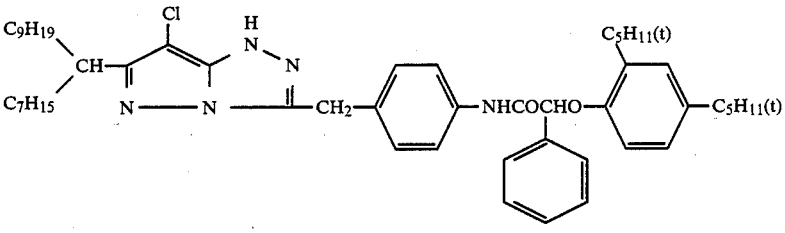
90
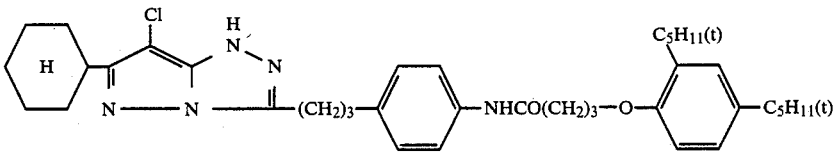

-continued
91
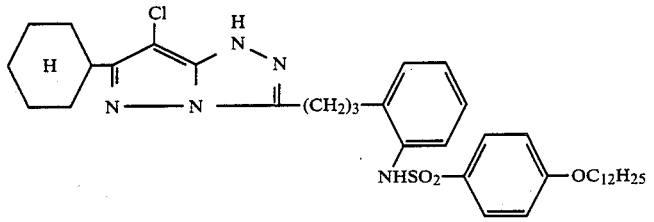
92
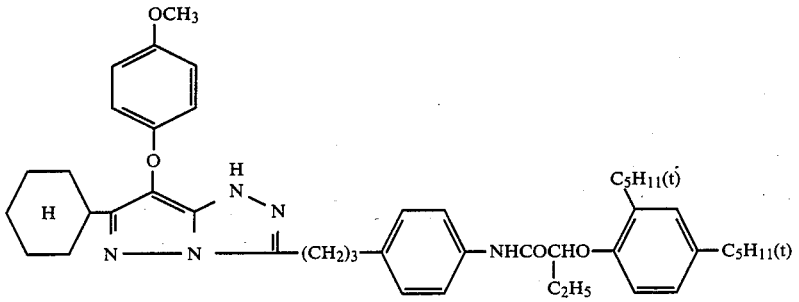
93
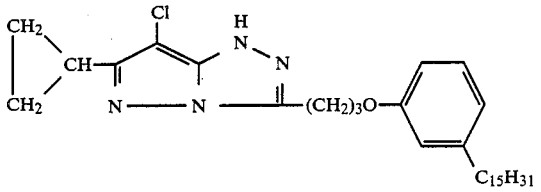
94
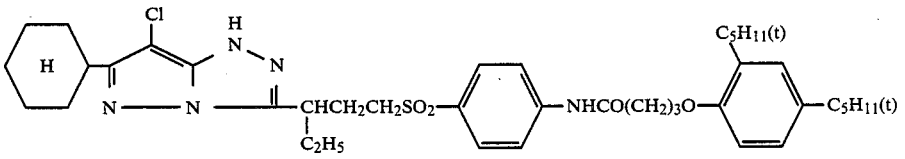
95
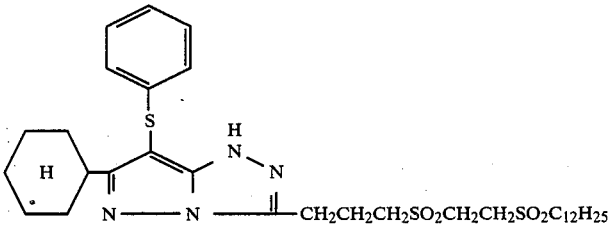
96
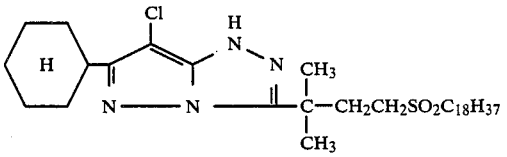
97
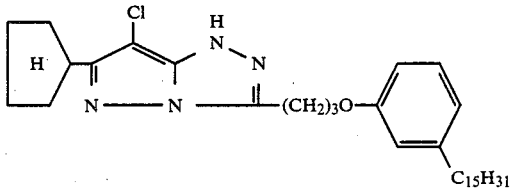

-continued
98
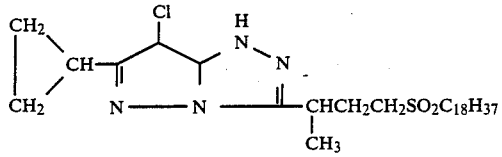
99
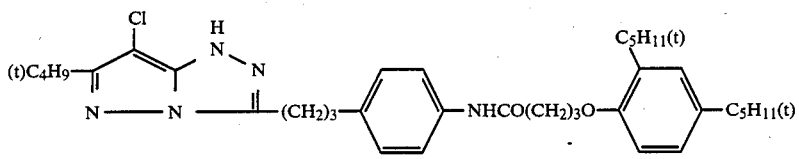
100
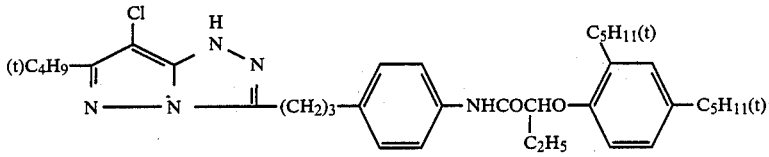
101
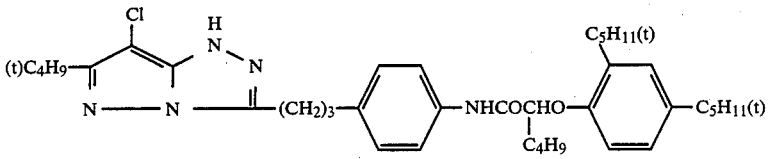
102
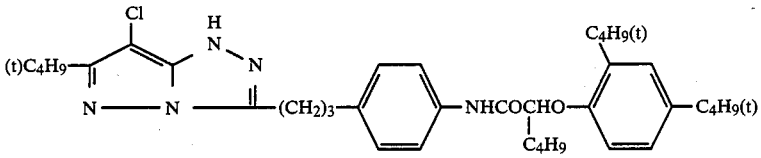
103
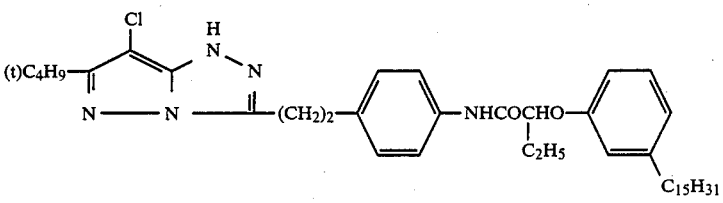
104
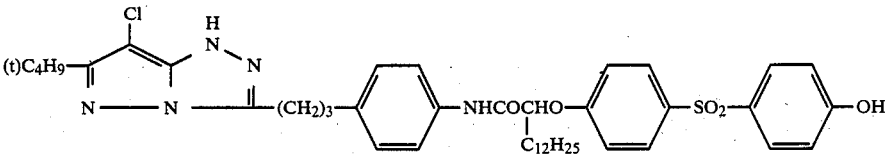
105
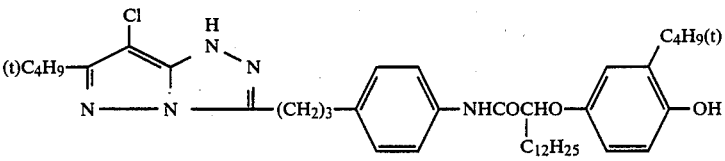
106
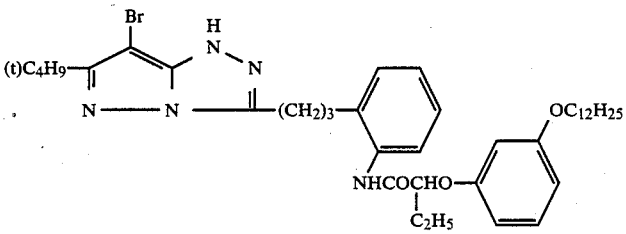

-continued
107
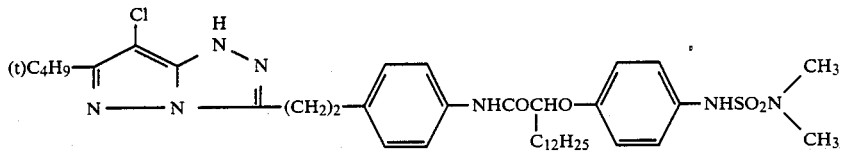
108
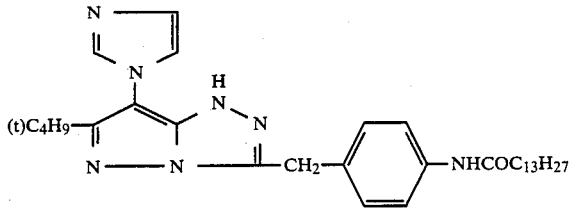
109
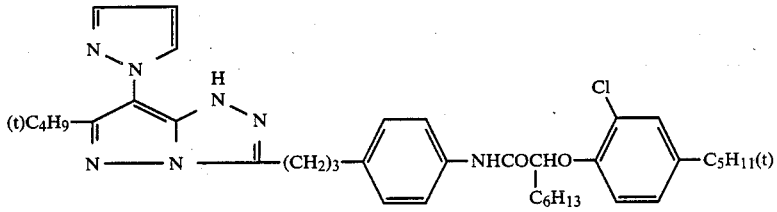
110
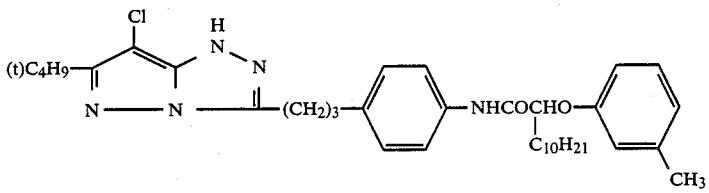
111
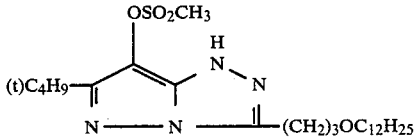
112
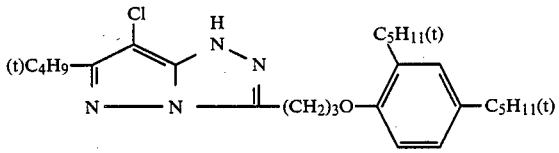
113
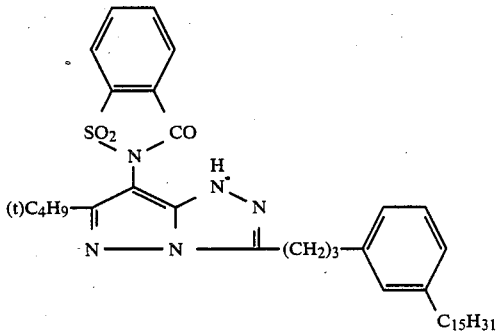
114
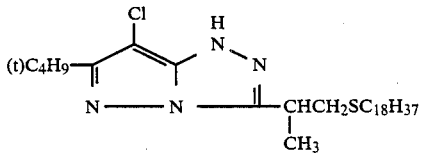

-continued
115
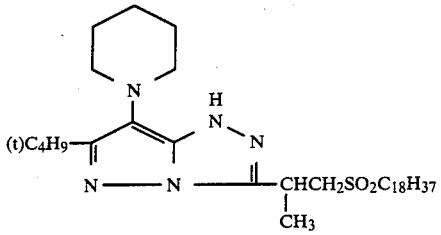
116
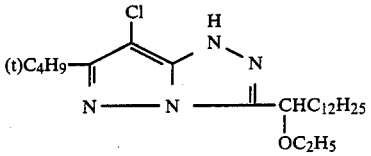
117
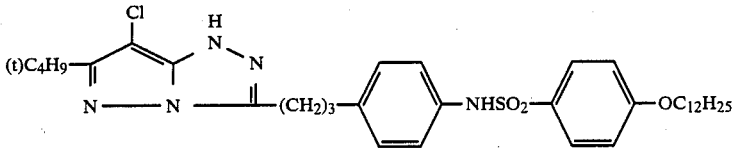
118
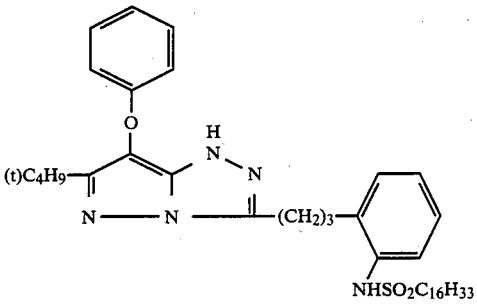
119
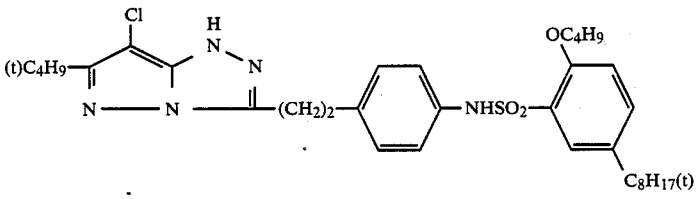
120
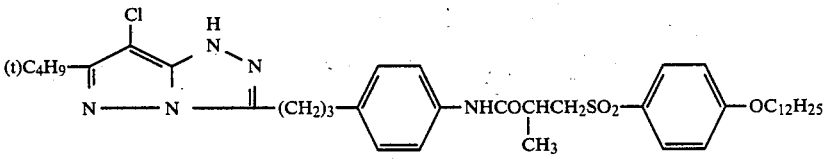
121
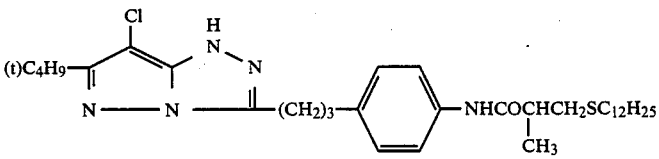
122
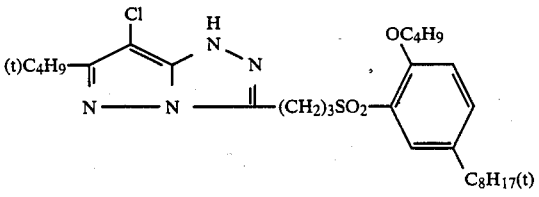

-continued
123
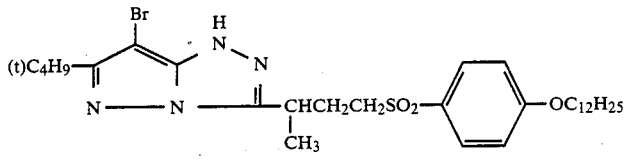
124
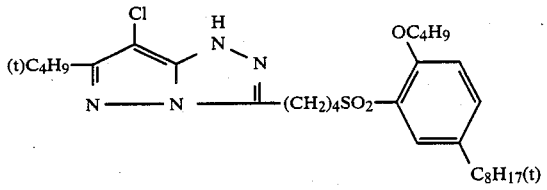
125
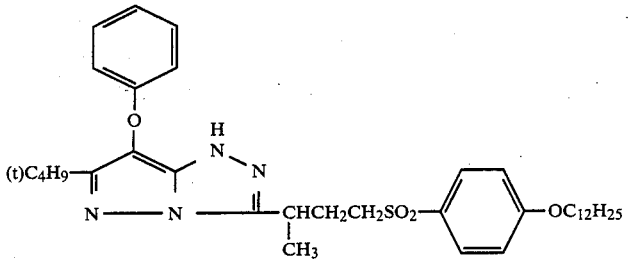
126
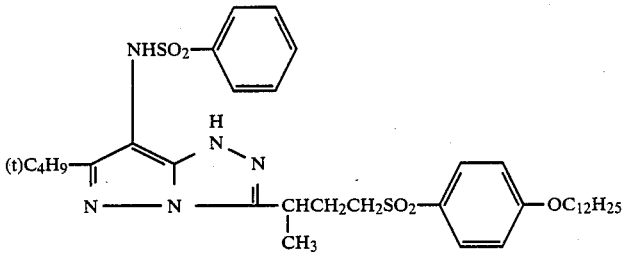
127
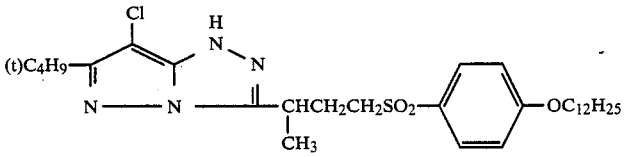
128
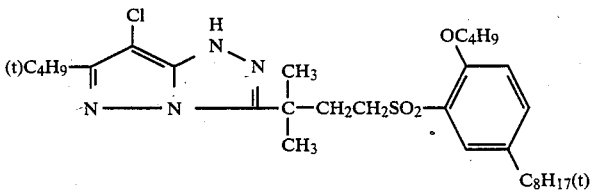
129
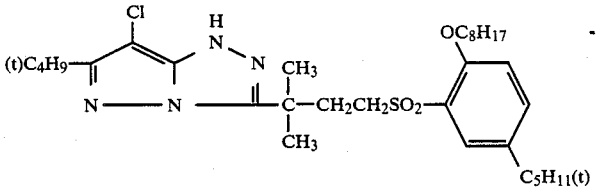
130
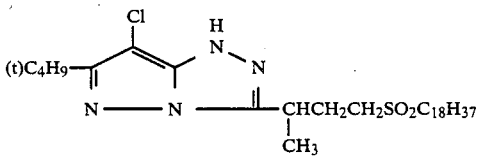

-continued
131
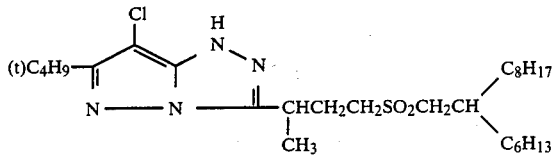
132
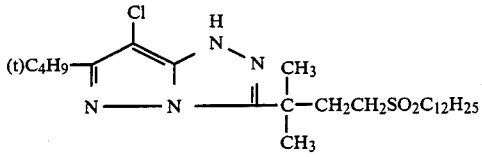
133
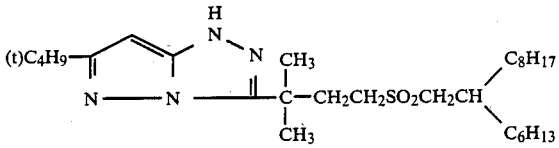
134
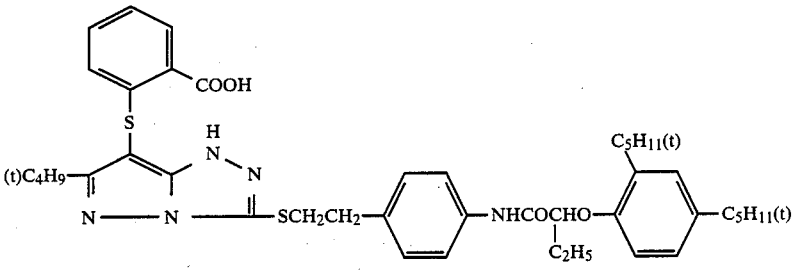
135
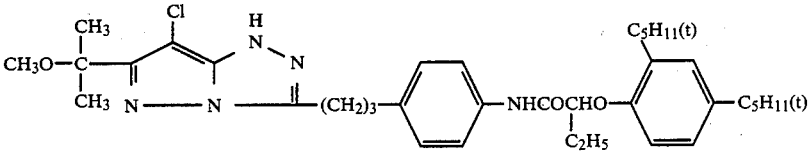
136
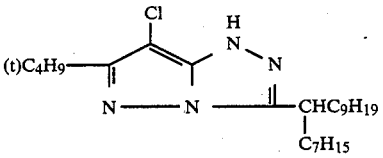
137
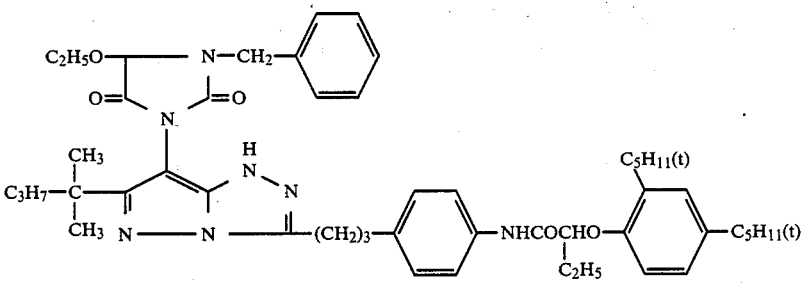
138
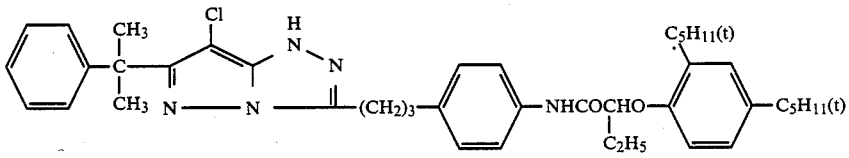

-continued
139
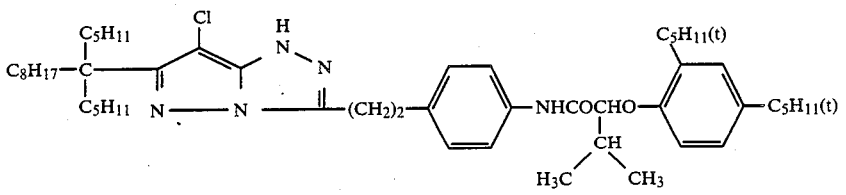
140
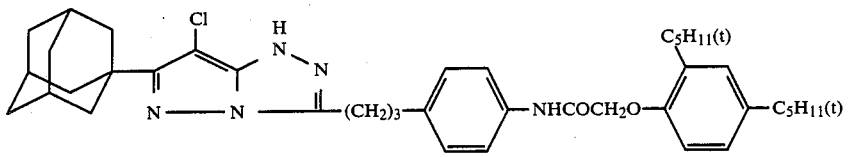
141
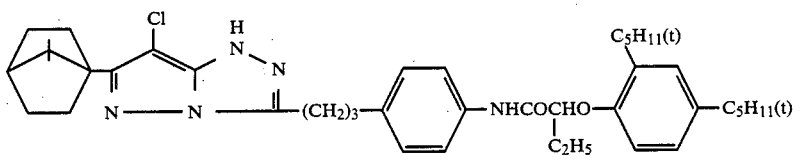
142
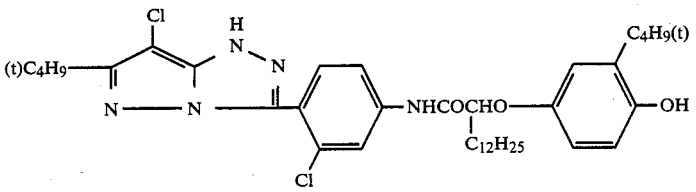
143
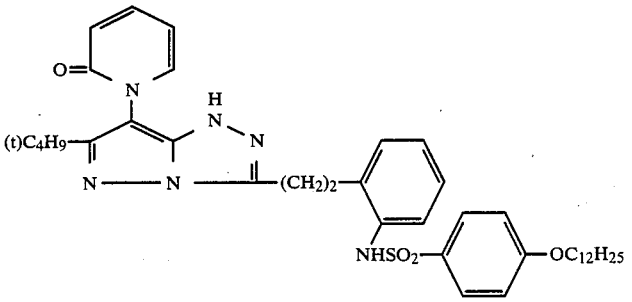
144
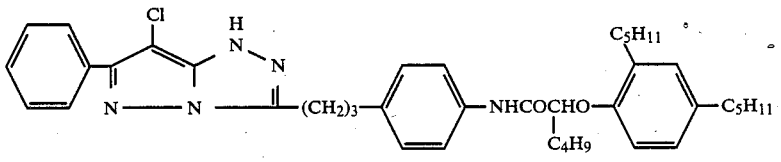
145
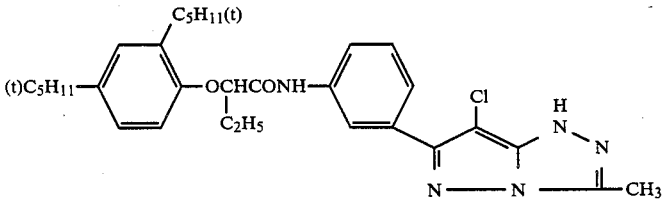
146
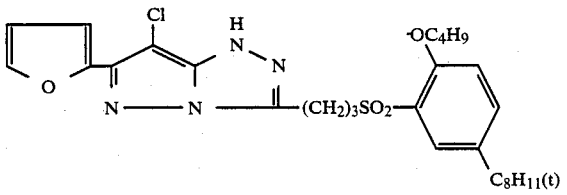

-continued
147
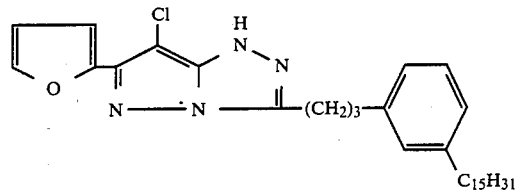
148
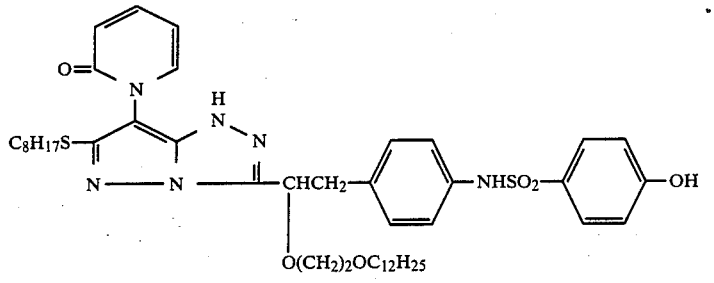
149
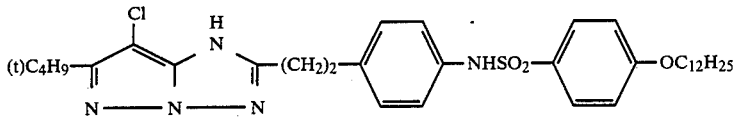
150
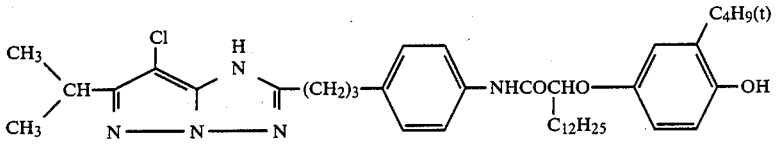
151
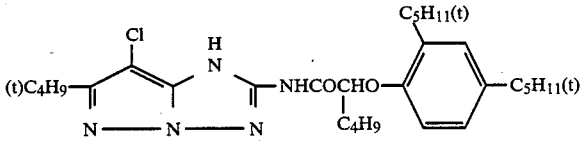
152
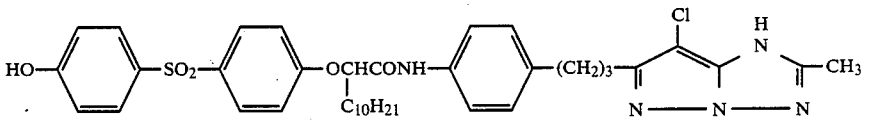
153
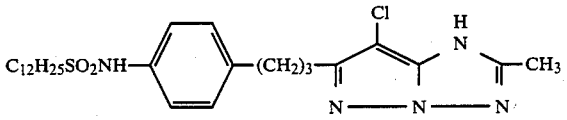
154
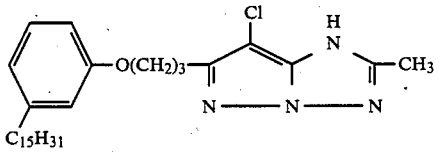
155
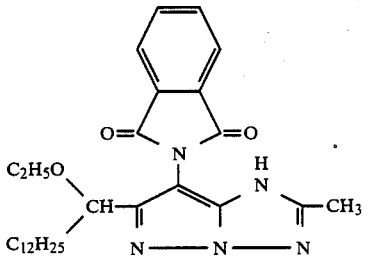

-continued
156
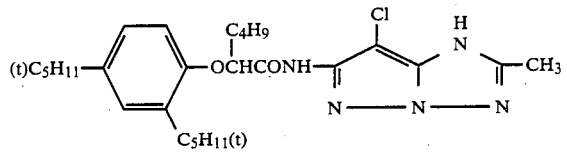
157
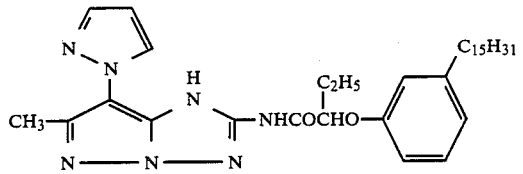
158
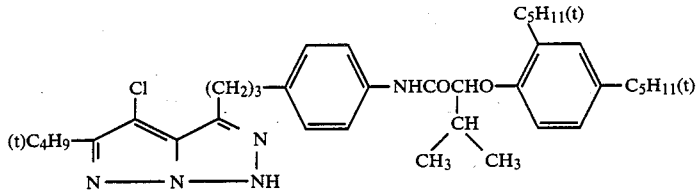
159
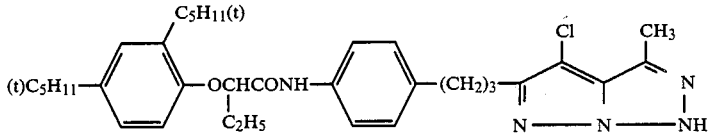
160
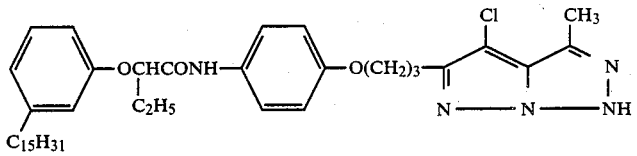
161
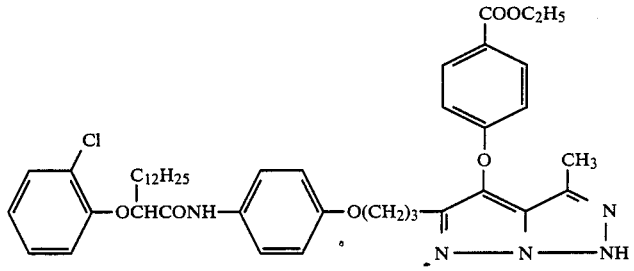
162
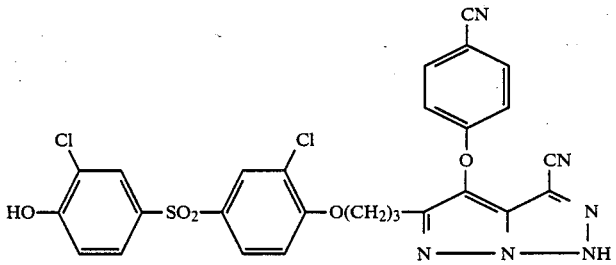
163
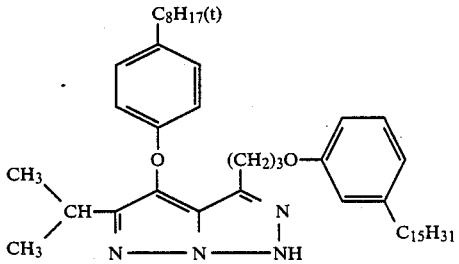

-continued
164
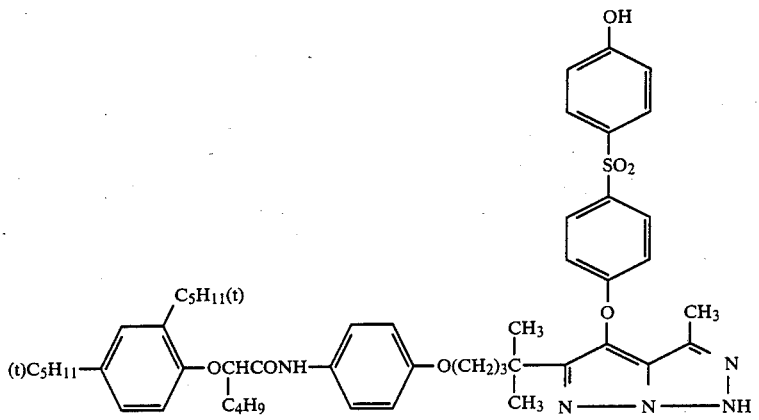
165
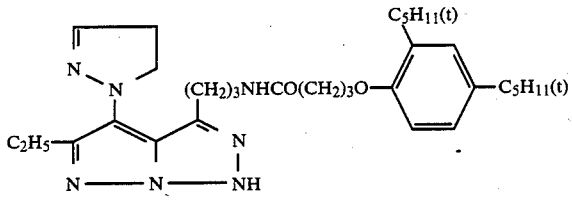
166
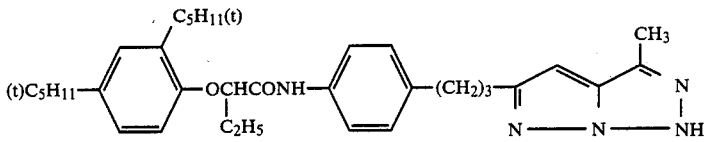
167
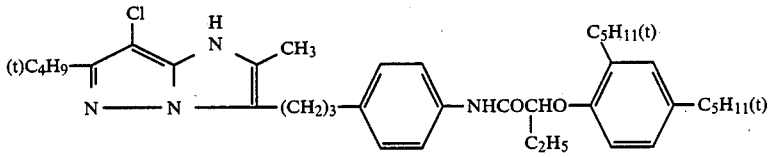
168
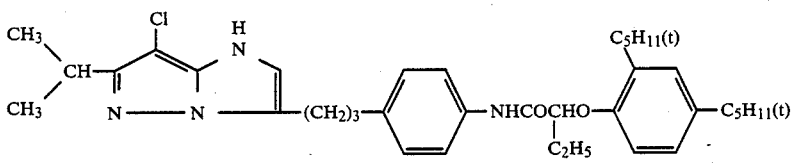
169
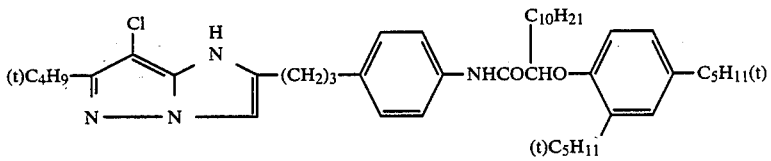
170
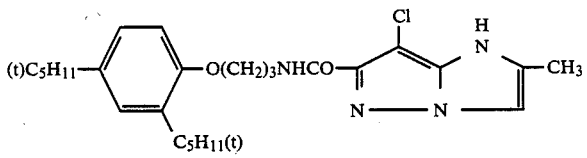
171
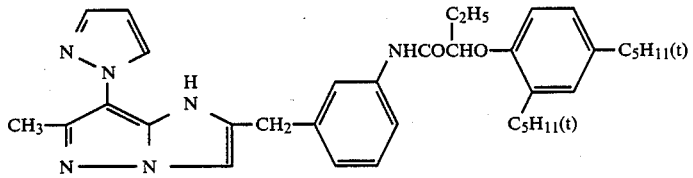

-continued
172
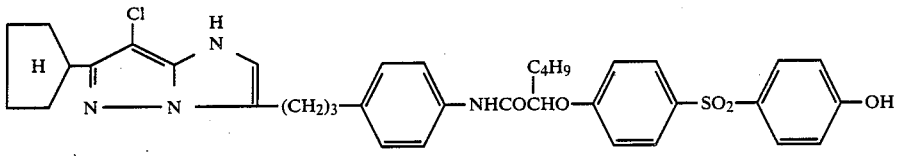
173
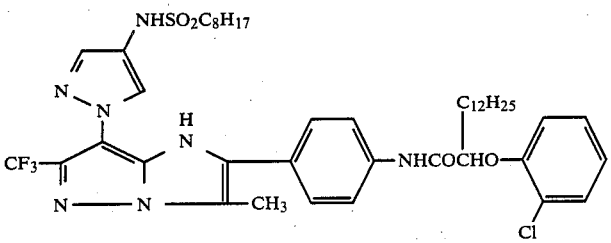
174
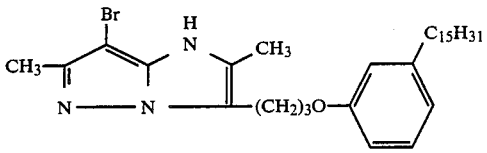
175
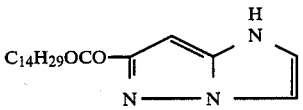
176
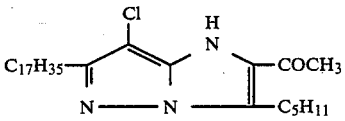
177
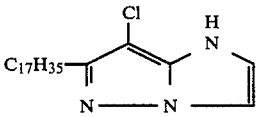
178
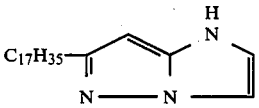
179
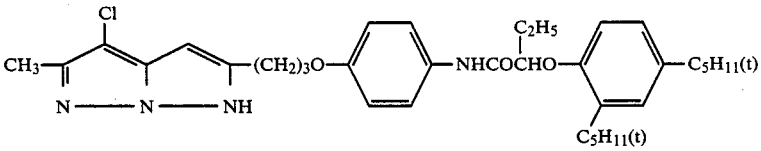
180
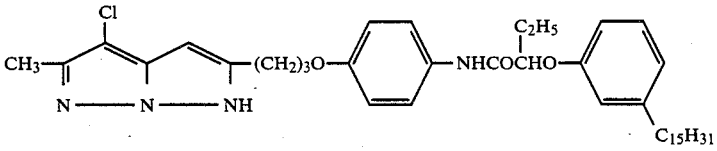

-continued
181
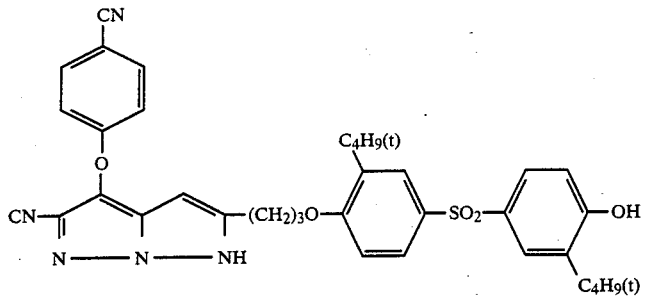
182
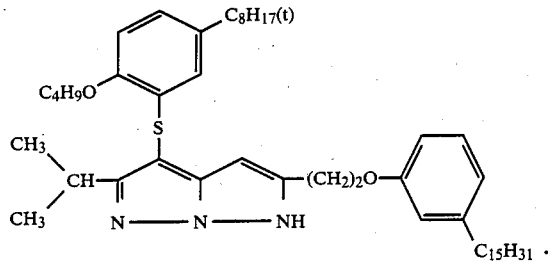
183
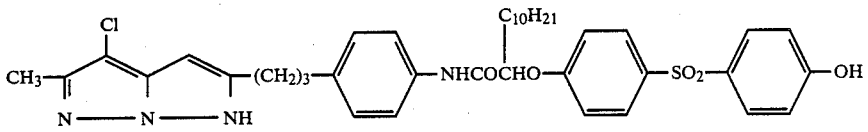
184
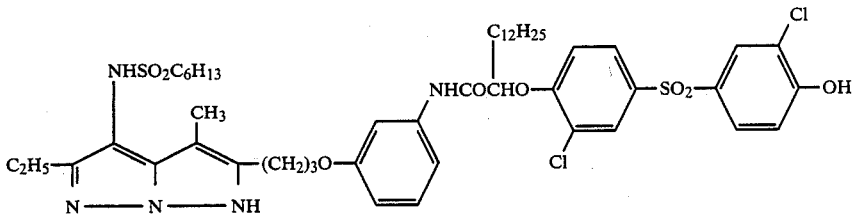
185
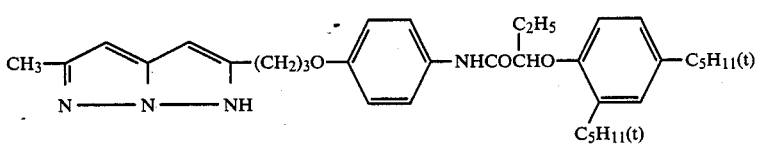
186
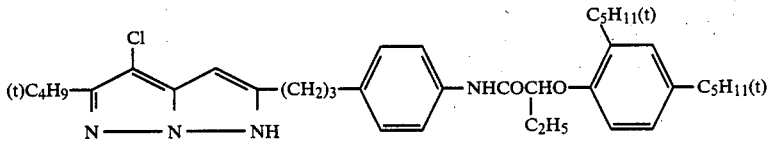
187
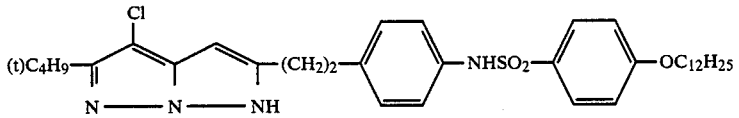
188
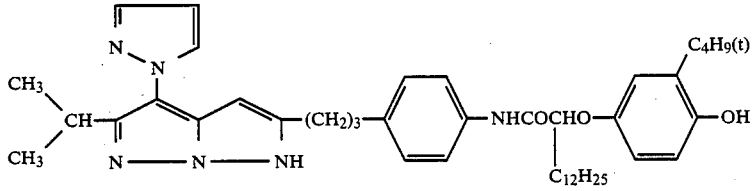

-continued
189
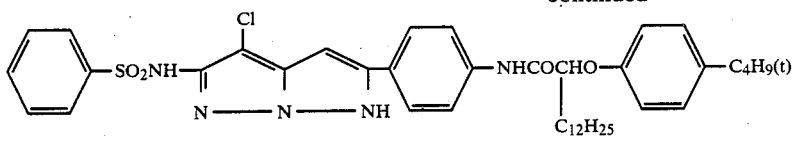
190
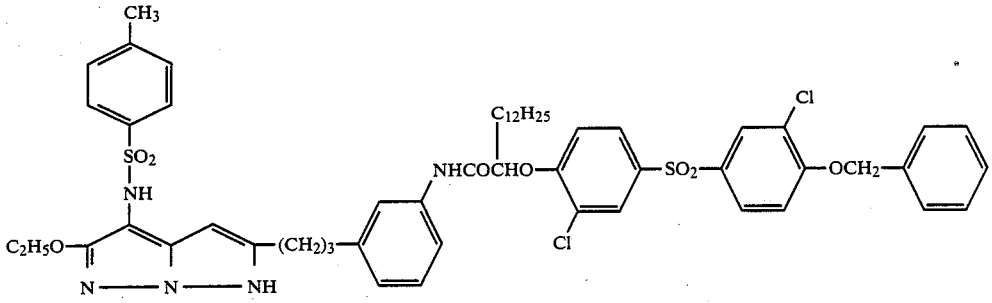
191
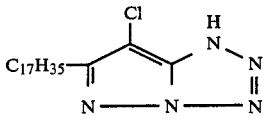
192
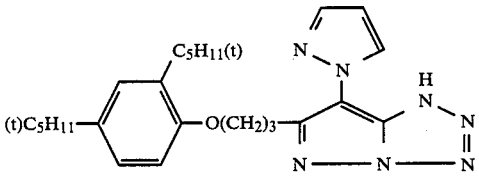
193
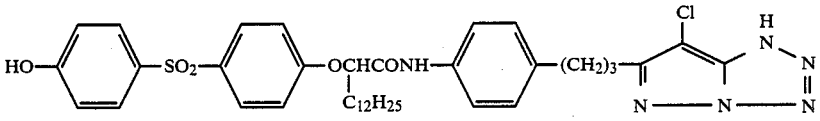
194
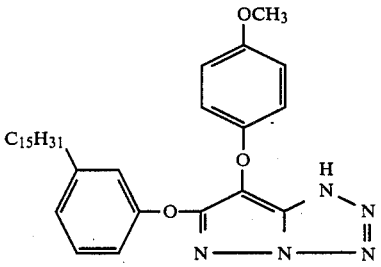
195
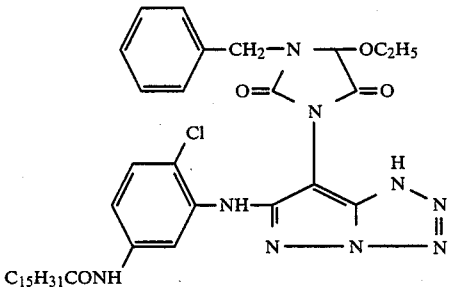
196
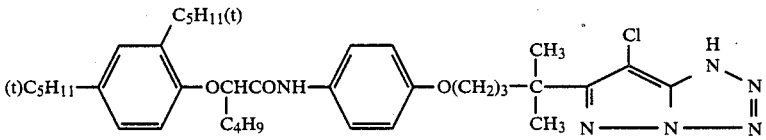

-continued

197

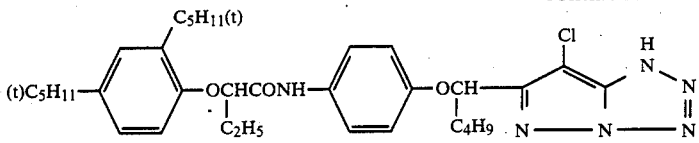

198

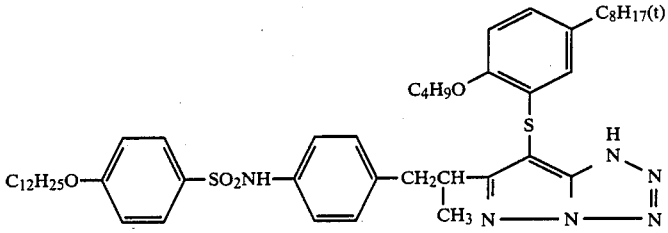

199

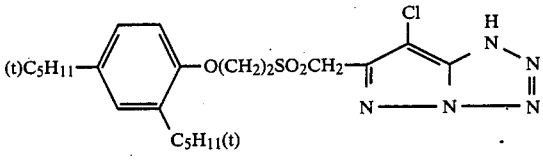

The above-mentioned typical couplers were synthesized by referring to 'Journal of the Chemical Society, Perkin I', 1977, pp. 2047-2052; U.S. Pat. No. 3,725,067; Japanese Patent O.P.I. Publication Nos. 99437/1984, 42045/1983, 162548/1984, 171956/1984, 33552/1985, 43659/1985 and the like.

The couplers of the invention may ordinarily be used in an amount of from $1\times10^{-3}$ mole to 1 mole, and more preferably from $1\times10^{-2}$ mole to $8\times10^{-1}$ mole, per mole of a silver halide.

The couplers of the invention may also be used together with the other kinds of magenta couplers.

The compounds used in combination with the couplers of the invention represented by the Formula [I] are the compounds having the following Formula [XII] (hereinafter referred to as the amine compounds of the invention):

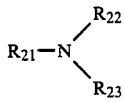

Formula [XII]

wherein $R_{21}$ represents a hydrogen atom, an alkyl ground, an alkenyl group, a cycloalkyl group or an aryl group; each of $R_{22}$ and $R_{23}$ represents an alkyl group, an alkenyl group, a cycloalkyl group or an aryl group.

The alkyl group represented by $R_{21}$, $R_{22}$ and $R_{23}$ denoted in the aforegiven Formula [XII] preferably include, for example, a normal or branch chained alkyl group having 1 to 24 carbon atoms such as a methyl, ethyl, isopropyl, t-butyl, 2-ethylhexyl, dodecyl, t-octyl or the like groups; a cycloalkyl group having 5 to 24 carbon atoms such as a cyclopentyl, cyclohexyl or the like groups; an alkenyl group having 3 to 24 carbon atoms such as an allyl, 2-4-pentadienyl or the like groups; an aryl group such as a phenyl and a naphtyl group.

Two out of the above-mentioned $R_{21}$, $R_{22}$ and $R_{23}$ are allowed to couple each other to form a phosphate bond.

Each of the above-mentioned $R_{21}$, $R_{22}$ and $R_{23}$ includes a group having a substituent. The substituents typically includes, for example, a hydroxy group, an alkoxy group, an aryl group, an acylamino group, a sulfonamide group, an aryloxy group, a carbamoyl group, a sulfamoyl group, a sulfonyl group, a vinylsulfonyl group, a nitro group, a cyano group, a halogen atom, a carboxyl group, an amino group, an alkylamino group, an alkoxycarbonyl group, an acyl group, an arylaminocarbonyloxy group, an acyloxy group, a heterocyclic group and the like.

The aryl groups are allowed to form a methylenedioxy ring in which two neighboring groups are coupled each other.

Among the compounds represented by the Formula [XII], preferable is the case where $R_{21}$, $R_{22}$ and $R_{23}$ satisfies the following cases (i) all of $R_{21}$, $R_{22}$ and $R_{23}$ are alkyl groups (ii) both of $R_{21}$ and $R_{22}$ are alkyl groups and $R_{23}$ is an aryl group.

The typical examples of the amine compounds of the invention will be given below, but the invention is not limited thereto.

| | |
|---|---|
| $(C_3H_7)_3N$ | HI-1 |
| $(C_6H_{13})_3N$ | HI-2 |
| $(C_{12}H_{25})_3N$ | HI-3 |
| $(C_4H_9)_2NCH_2CH_2OH$ | HI-4 |
| $(C_{18}H_{37})_2NH$ | HI-5 |
| $(CH_3)_2NCH_2CH_2CH_2N(CH_3)_2$ | HI-6 |
| $C_{14}H_{29}NHCH_2CH_2CN$ | HI-7 |
| $C_{18}H_{37}N(CH_2CH_2OH)_2$ | HI-8 |
| $(C_{12}H_{25})_2NCH_2CH_2CN$ | HI-9 |
| $C_{12}H_{25}N(CH_2CH{=}CH_2)_2$ | HI-10 |

HI-11

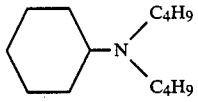

$(CH_3\underset{\underset{OH}{|}}{C}HCH_2)_2NCH_2N(CH_2\underset{\underset{OH}{|}}{C}HCH_3)_2$ HI-12

HI-13

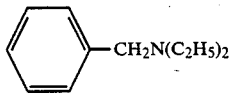

-continued
HI-14
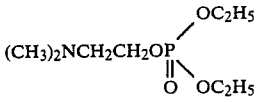
HI-15
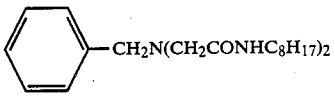
HI-16
$C_{12}H_{25}N(CH_2CH_2OC_{12}H_{25})_2$
HI-17
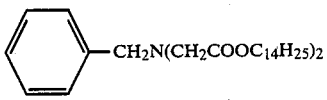
HI-18
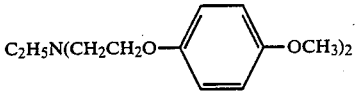
HI-19
$C_{18}H_{37}N(CH_2CH_2SO_2C_8H_{17})_2$
HI-20
$C_{12}H_{25}N(CH_2CH_2SO_2NHC_4H_9)_2$
HI-21
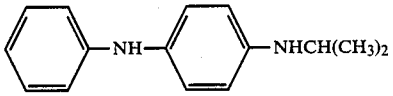
HI-22
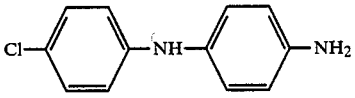
HI-23
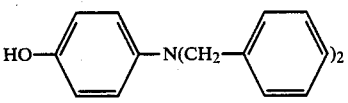
HI-24
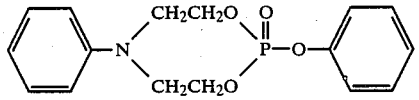
HI-25
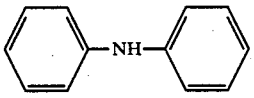
HI-26
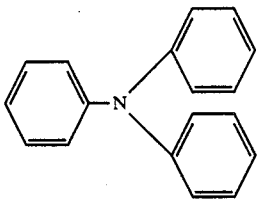
HI-27
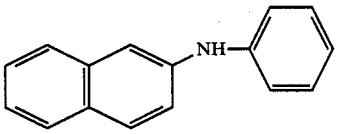
-continued
HI-28
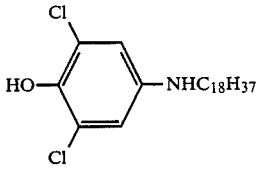
HI-29
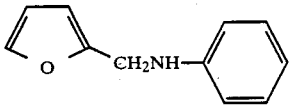
HI-30
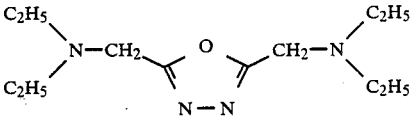
HI-31
$CH_2{=}CHSO_2CH_2CH_2NHCH_2CH_2NHCH_2CH_2SO_2CH{=}CH_2$
HI-32
$H_2NCH_2CH_2NHCH_2CH_2NHCH_2CH_2NH_2$
HI-33
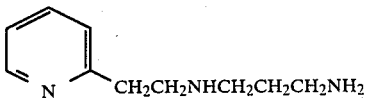
HI-34
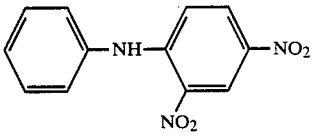
HI-35
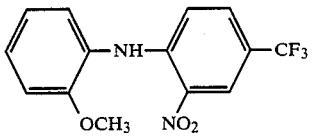
HI-36
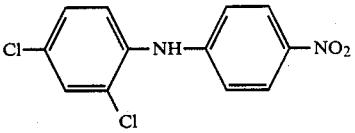
HI-37
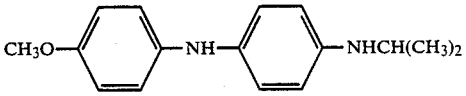
HI-38
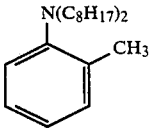
HI-39
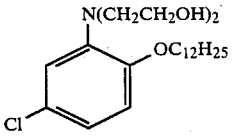

-continued
HI-40
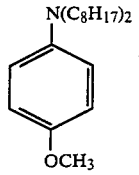
HI-41
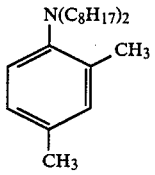
HI-42
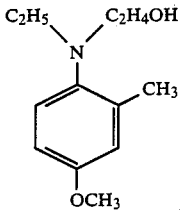
HI-43
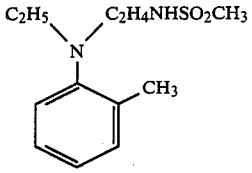
HI-44
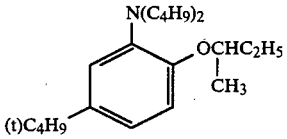
HI-45
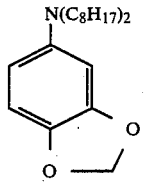
HI-46
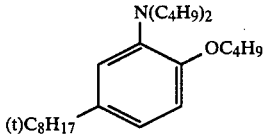
HI-47
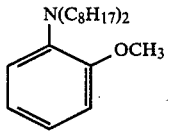
HI-48
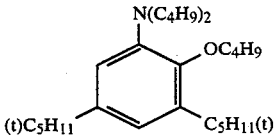
-continued
HI-49
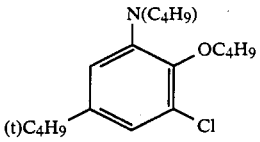
HI-50
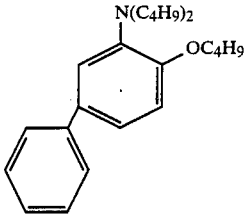
HI-51
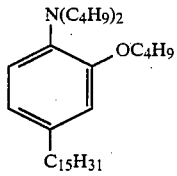
HI-52
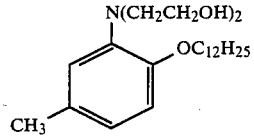
HI-53
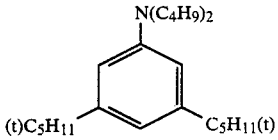
HI-54
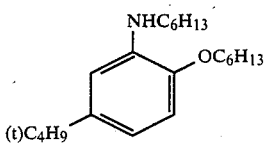
HI-55
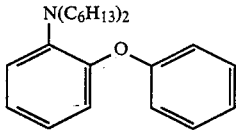
HI-56
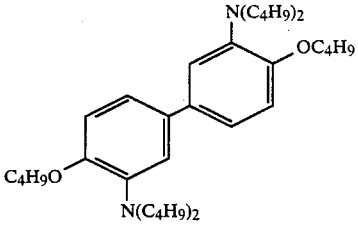
HI-57
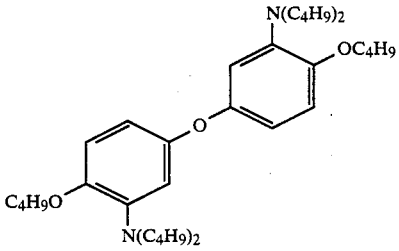

-continued
HI-58
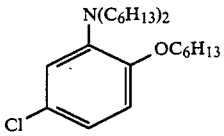
HI-59
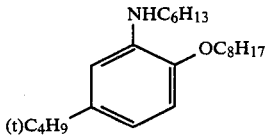
HI-60
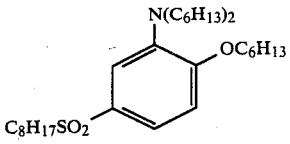
HI-61
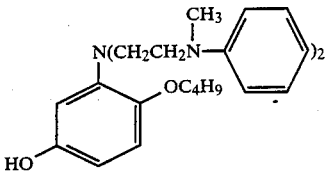
HI-62
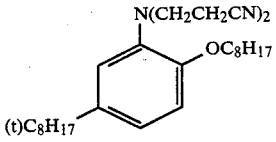
HI-63
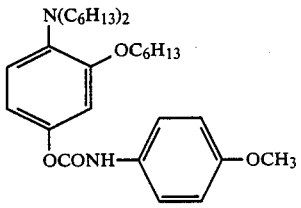
HI-64
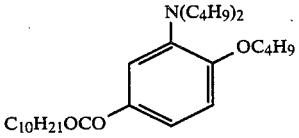
HI-65
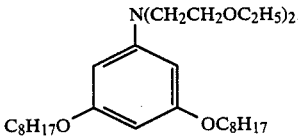
HI-66
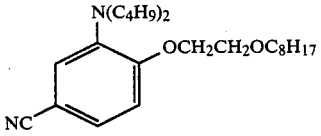
HI-67
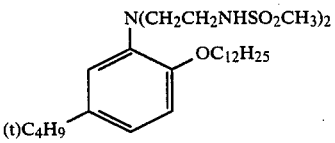
-continued
HI-68
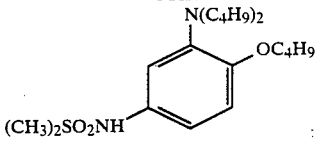
HI-69
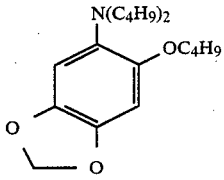
HI-70
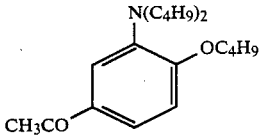
HI-71
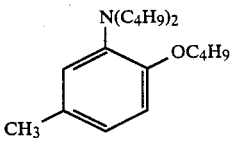
HI-72
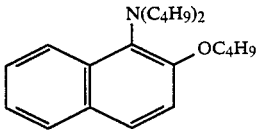
HI-73
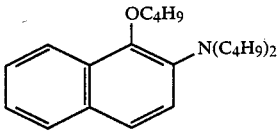
HI-74
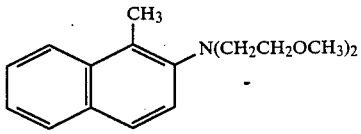
HI-75
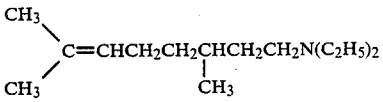
HI-76
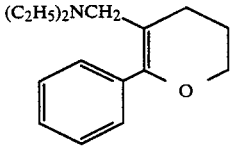
HI-77
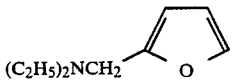
HI-78
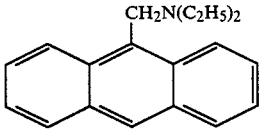
The amine compounds of the invention can be synthesized by the well-known methods such as that described in 'Methoden der organischen chemine, Band XI/1' by Houben-Weyl, E. Muller.

The amine compounds of the invention are used in an amount of from 5 to 400 mole %, and more preferably from 10 to 300 mole % to the coupler of the invention represented by the afore-mentioned Formula [I].

The amine compounds of the invention are described in Japanese Patent Examined Publication No. 47245/1972, Japanese Patent O.P.I. Publication No. 105147/1983 and 229557/1984. In Japanese Patent Examined Publication No. 47245/1972, it is described that the amine compounds are effective for preventing azomethine dyes and indoaniline dyes from light fading. However, these amine compounds have much less anti-fading effects against azomethine dyes formed from 5-pyrazolone compared with other anti-fading agents such as the compounds having the following Formula [XIII].

Japanese Patent O.P.I. Publications Nos. 105147/1983 and 229557/1984, it is described that the amine compounds have effects of preventing unexposed area from magenta stain occurred in development process provided that the amine compounds are used with two equivalent pyrazolone magenta coupler. However, though the amine compounds have anti-magenta-stain effects, there is a drawback that the amine compounds themselves turn yellow and the yellow stain is increased.

In the afore-mentioned Japanese Patent Examined Publication No. 47245/1972, it is described that the amine compounds cause no such coloration or discoloration as ultraviolet absorbing agents cause, however, the coloration of the amine compounds can not be ignored in the field of recent photographic materials of which an excellent image quality is required. Further the amine compounds have a great drawback of lowering sensitivity when they are used together with a 5-pyrazolone magenta coupler, as a result they have not been used so far for color photographic materials.

These prior arts have not foreseen that the remarkable anit-fading effects such as those of the invention can be displayed only when the amine compounds are used with a pyrazolotrizole type coupler and that the yellowing and the lowering of sensitivity which are conventional drawbacks can not be caused.

In the silver halide photographic materials of the invention, the amine compounds of the invention are allowed to be used in combination with phenole compounds and phenylether compounds represented by the following Formula [XIII].

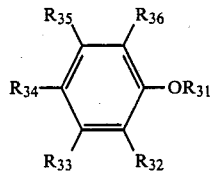

Formula [XIII]

wherein $R_{31}$ represents a hydrogen atom, an alkyl, alkenyl, aryl or heterocyclic group; $R_{32}$, $R_{33}$, $R_{35}$ and $R_{36}$ represent a hydrogen atom, a halogen, a hydroxy, alkyl, alkenyl, aryl, alkoxy or acylamino group, respectively; and $R_{34}$ represents an alkyl, hydroxy, aryl or alkoxy group.

Further, $R_{31}$ and $R_{32}$ may close their rings to form a 5-or 6-membered ring, and when this is the case, $R_{34}$ represents a hydroxy or alkoxy group. And further $R_{31}$ and $R_{32}$ may close their rings to form a methylenedioxy ring. Still further, $R_{33}$ and $R_{34}$ may close their rings to form a 5-membered hydrocarbon ring and when this is the case, $R_{31}$ represents an alkyl, aryl or heterocyclic ring, provided that, however, $R_{31}$ is not a hydrogen atom and $R_{34}$ is not hydroxy group.

In the above-given Formula [XIII], $R_{31}$ represents a hydrogen atom, an alkyl, alkenyl, aryl or heterocyclic group, however, among them, the alkyl groups are the normal chained or branch chained ones including, for example, a methyl, ethyl, propyl, n-octyl, tert-octyl, benzyl, hexadecyl or the like group. These alkyl groups may have substituents. The alkenyl groups represented by $R_{31}$ include, for example, an allyl, hexenyl, octenyl or the like group. Further, the aryl groups represented by $R_{31}$ include, for example, a phenyl or naphthyl group. These aryl groups may have substituents such as, for example, a methoxyphenyl, chlorophenyl group or the like groups. Still further, the heterocylic groups represented by $R_{31}$ typically include, for example, a tetrahydropyranyl, pyrimidyl or the like group.

In Formula [XIII], $R_{32}$, $R_{33}$, $R_{35}$ and $R_{36}$ represent a hydrogen atom, a halogen atom, a hydroxy, alkyl, alkenyl, aryl, alkoxy or acylamino group and, among them, the alkyl, alkenyl and aryl groups include the same ones as those alkyl, alkenyl and aryl groups represented by $R_{31}$. The above-mentioned halogen atom include, for example, fluorine, chlorine, bromine and the like. Further, the above-mentioned alkoxy groups typically include, for example, a methoxy, ethoxy, benzyloxy group or the like group. Still further, the above-mentioned acylamino groups are represented by R'NHCO—, wherein R' represents an alkyl group such as a methyl, ethyl, n-propyl, n-butyl, n-octyl, tert-octyl or benzyl group, or the like groups; an alkenyl group such as an allyl, octynyl or oleyl group, or the like groups; an aryl group such as phenyl, methoxyphenyl or naphthyl group, or the like groups; or a heterocyclic group such as a pyridyl or pyrimidyl group.

In Formula [XIII], $R_{34}$ represents an alkyl, hydroxy, aryl or alkoxy group and, among them, the alkyl and aryl groups typically include the same ones as those given for the alkyl and aryl groups represented by $R_{31}$; and the alkenyl groups represented by $R_{34}$ include the same ones as those given in the alkoxy groups represented by $R_{32}$, $R_{33}$, $R_{35}$ and $R_{36}$, respectively.

Among the phenol or phenylether compounds represented by the aforegiven Formula [XIII] used in combination with the couplers of the invention, the particularly preferable ones are tetraalkoxybiindone compounds, which are represented by the following Formual [XIV];

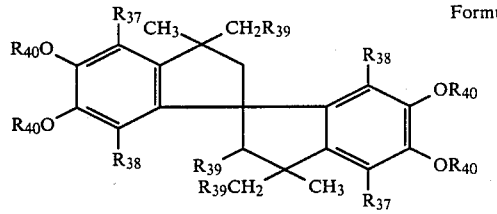

Formula [XIV]

wherein $R_{40}$ represents such an alkyl group as a methyl, ethyl, propyl, n-octyl, tert-octyl, benzyl or hexadecyl group; such an alkenyl group as an allyl, octenyl or oleyl group; such an aryl group as a phenyl or naphthyl group; or such a heterocyclic grous as a tetrahydropyranyl or pyrimidyl group.

$R_{37}$ and $R_{38}$ each represent a hydrogen atom, such a halogen atom as fluorine, chlorine or bromine, such an alkyl group as a methyl, ethyl, n-butyl or benzyl group; such an alkenyl group as an allyl, hexenyl or octenyl group; or such an alkoxy group as a methoxy, ethoxy or benzyloxy group.

And, $R_{39}$ represents a hydrogen atom, such an alkyl group as a methyl, ethyl, n-butyl or benzyl group; such an alkenyl group as a 2-propenyl, hexenyl or octenyl group; or such an aryl group as a phenyl, methoxyphenyl, chlorophenyl or naphthyl group.

The compounds represented by the aforegiven Formula [XIII] include those described in U.S. Pat. Nos. 3,935,016, 3,982,944 and 4,254,216; Japanese Patent O.P.I. Publication Nos. 21004/1980 and 145530/1979; British Patent Nos. 2,077,455, and 2.062,888; U.S. Pat. Nos. 3,764,337, 3,432,330, 3,574,627 and 3,573,050; Japanese Patent O.P.I. Publication Nos. 152225/1977, 20327/1978, 17729/1978 and 6321/1977; British Patent No. 1,347,556; British Patent Open to Public Inspection No. 2,066,975; Japanese Patent Examined Publication Nos. 12337/1979 and 31625/1973; U.S. Pat. No. 3,700,455; and the like.

The typical examples of the compounds represented by Formula [XIII] will be given below, but the invention is not limited thereto.

PH-1

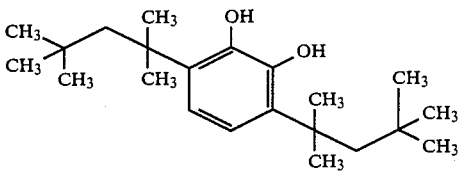

PH-2

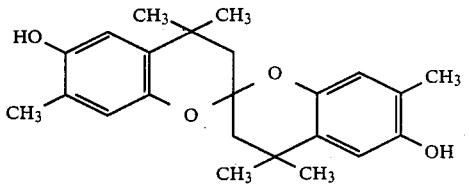

PH-3

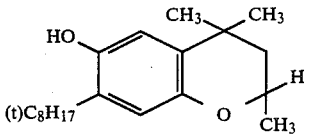

PH-4

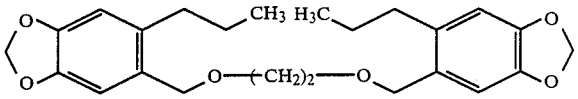

PH-5

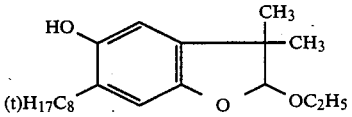

PH-6

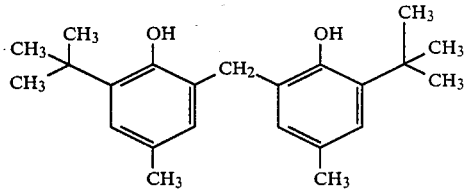

PH-7

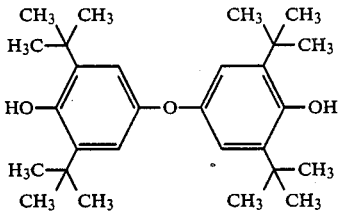

PH-8

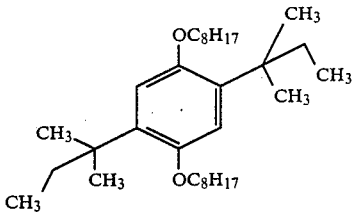

PH-9

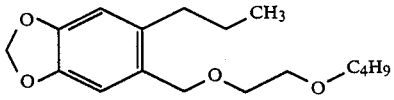

PH-10

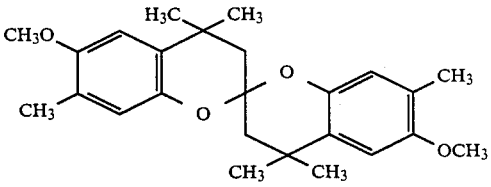

PH-11

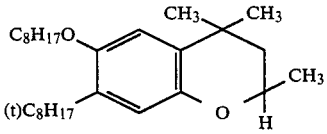

PH-12

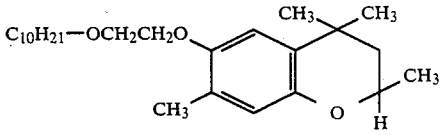

-continued
PH-13
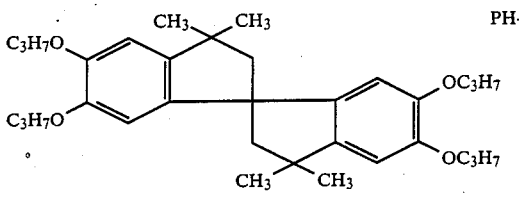
PH-14
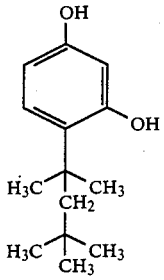
PH-15
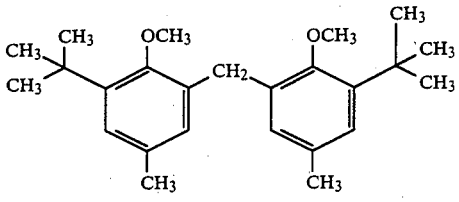
PH-16
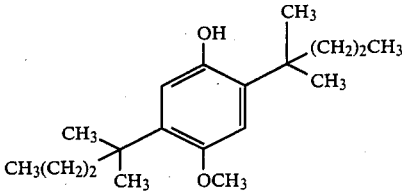
PH-17
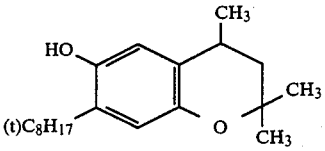
PH-18
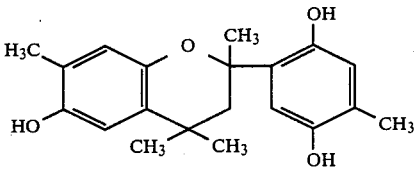
PH-19
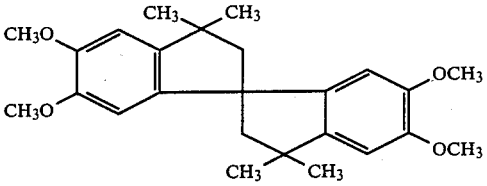
PH-20
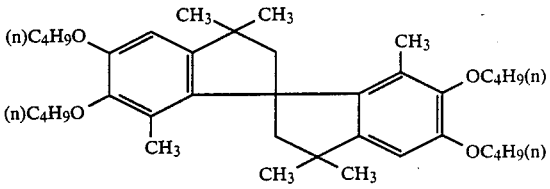
PH-21
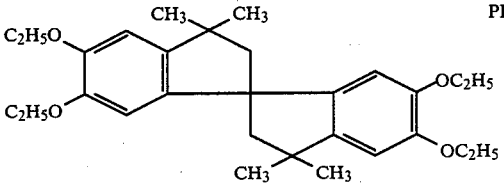
PH-22
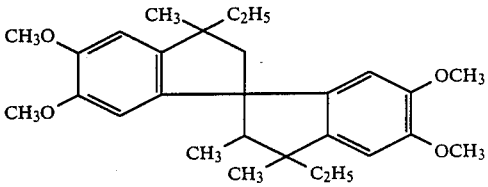
PH-23
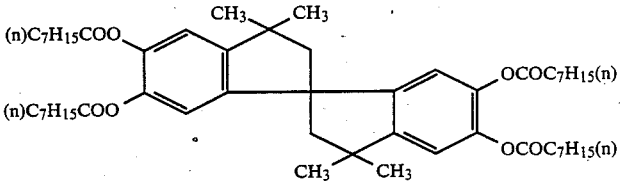
PH-24
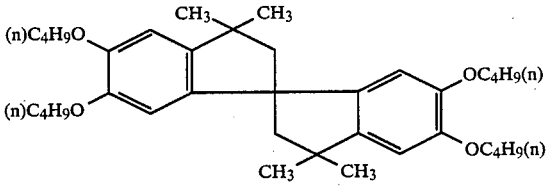
PH-25
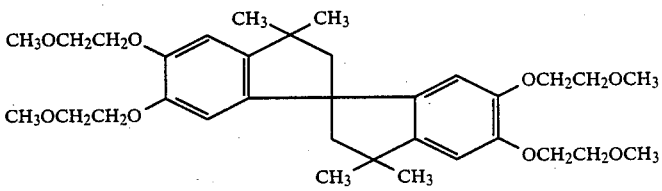

-continued

PH-26

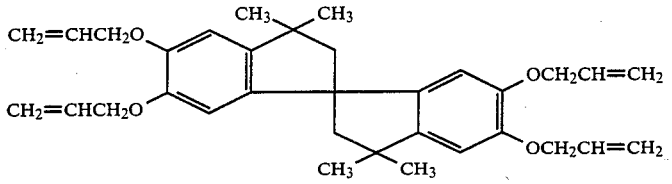

PH-27

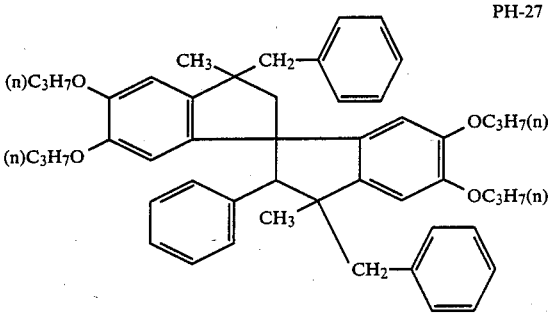

PH-28

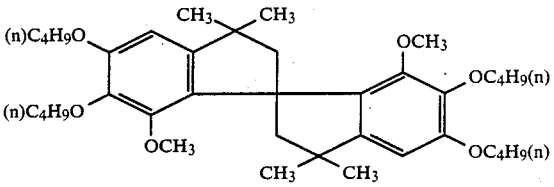

PH-29

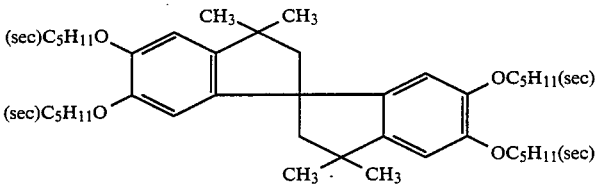

PH-30

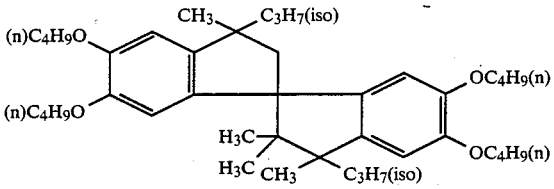

PH-31

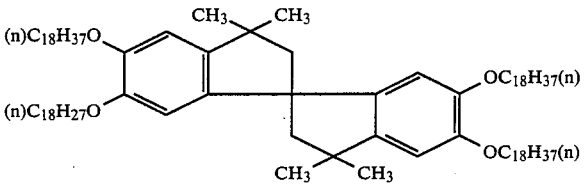

PH-32

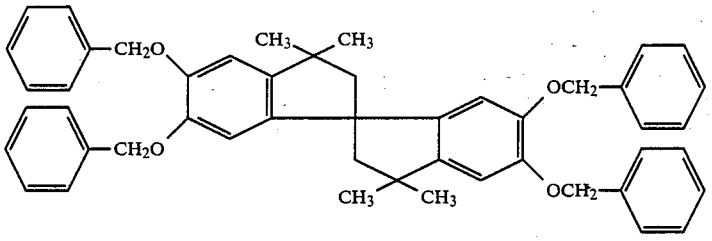

The phenol type compounds or the phenylether type compounds represented by the aforegiven General Formula [XIII] may be used in an amount of preferably not more than 200 mol % and more preferably not more than 140 mol % to the amine compounds of the invention represented by the General Formula [XII].

Most of the above-mentioned phenol type compounds or the phenylether compounds have an effect on preventing the fading of a magenta dye-imate obtained from the aforementioned magenta couplers of the invention, however, they are of almost no effect on preventing the discoloration. The undesired instances are often resulted when the above-mentioned phenol and phenylether compounds are excessively applied to the amine compounds relating to the invention.

Generally, the magenta dye-images obtained from the above-mentioned magenta couplers show not only a serious fading caused by light but also a serious discoloration also caused by light, so that the color tone of the dye-image may be changed from magenta into yellowish tone. Thanking to the fact that the amine compounds of the invention represented by the General Formula [XII] can prevent the light fading and discoloration of a magenta dye-image obtained from the above-mentioned magenta couplers, they can display an effect such as that the conventional type phenol and phenylether compounds are unable to display.

It is preferred that the couplers relating to the invention and the amine compounds relating to the invention are used in one and the same layer, and it is, however, allowed that the amine compounds may be used in a layer adjacent to the layer containing the couplers.

The silver halide photographic materials of the invention are applied to, for example, a color-negative film, a color-positive film, a color-printing paper and the like and, inter alia, the advantages of the invention can effectively be displayed especially when they are applied to a color-printing paper exhibited for direct appreciation.

The silver halide photographic material of the invention including the color-printing paper may be for either monochromatic or multichromatic use. In a silver halide photographic material for multichromatic use, for the purpose of color-reproducing an image in a color substractioon process, silver halide emulsion layers and non-light-sensitive layers containing a magenta, yellow and cyan couplers each serving as the couplers for photographic use are provided on the support in suitable quantity and arrangement order. Such quantity and arrangement order of the layers may suitably be changed according to the priority properties and the purposes of using.

In the silver halide emulsions used in the silver halide photographic materials of the invention, there may be used any one of such a silver halide as silver bromide, silver iodobromide, silver iodochloride, silver chlorobromide, silver chloride and the like, which are commonly used in popular type silver halide emulsions.

The silver halide grains used in the silver halide emulsions may be those prepared in any one of the so-called acid process, neutral process and ammonia process. Such grains may be grown at one time or after a seed grains were grown. The processes of preparing such seed grains and the processes of growning them may be the same or the different.

In such silver halide emulsions, a halide ion and a silver ion may be mixed up at the same time, or one may be mixed in the other. Further, silver halide crystals may be grown by adding halide ions and silver ions little by little at the same time by taking a critical crystal-growth rate of silver halide crystals into consideration and with controlling a pH value and a pAg value in a mixing tank. It is also allowed to change the halogen composition of grains thereof in a conversion process, after the growth thereof.

If required, the sizes, configurations, size distributions and growth rates of silver halide grains may be controlled by making use of a silver halide solvent in the course of preparing a silver halide emulsion.

In the course of forming and/or growing the silver halide grins to be used in a silver halide emulsion, metal ions are added therein by making use of a cadmium, a zinc salt, a lead salt, a thallium salt, an iridium salt or the complex salts thereof, a rhodium salt or the complex salts thereof, or an iron salt or the complex salts thereof, so that they may be held in the grains and/or on the surfaces of the grains. When they are put in a suitable reducible atmosphere, reduction sensitization nuclei may be provided into such a grains and/or onto the surfaces thereof.

After completing the growth of silver halide grains, unnecessary soluble salts may be removed from such silver halide emulsions, or may remain contained therein. If such salts should be removed, it may be carried out in accordance with the method described in Research Disclosure No. 17643.

The silver halide grains to be used in such silver halide emulsions may comprise a layer of which the inside and the surface are uniform, or a layer of which the inside and the surface are different from each other.

The silver halide grains to be used in such silver halide emulsions may be those capable of forming a latent image on the surface thereof, or those capable of forming a latent image mainly inside thereof.

The silver halide grains to be used in such silver halide emulsions may be those each having a regular crystal form, or those each having such an irregular form as a spherical form or a plate form. In these grains, it is allowed to use those each having any ratio of a {100} face to a {111} face and, in addition, it is also allowed to use the grains each having a compound crystal form, or a mixture of variously crystallized grains.

It is also allowed to use a mixture of not less than two kinds of silver halide emulsions each prepared separately.

Such silver halide emulsions are chemically sensitized in an ordinary process. Namely, a sulfur sensitization process using a compound containing sulfur capable of reacting with silver ions, and an active gelatin; a selenium sensitization process using a selium compound; areduction sensitization process using a reducible substance; a noble metal sensitization process using a gold compound or other noble metal compounds; and the like processes. These processes may be used independently or in combination.

The silver halide emulsions may be optically sensitized to a desired wavelength region by making use of such a dye as has been well-known as a spectral sensitizing dye in the photographic industry. Such spectral sensitizing dyes may be used independently or in combination. The emulsions are also allowed to contain, as well as the above-mentioned spectral sensitizing dyes, such a dye as is intrinsically incapable of sensitizing the emulsions or a supersensitizer which is a compound not substantially absorbing any visible rays of light and strengthening the sensitizing characteristics of the spectral sensitizing dyes.

In the silver halide emulsion, there may be added with a compound which has been well-known as a antifoggant or a stabilizer in the photographic industry, with the purposes of preventing a fog caused in the course of manufacturing, preserving or processing a light-sensitive material and/or stabilizing the photographic characteristics of the emulsions, during, when completing and/or after completing a chemical sensitization before coating the silver halide emulsions on the light-sensitive material.

As for the binders (or the protective colloids) in a silver halide emulsion, a gelatin may advantageously be used, however, besides the gelatin, such a hydrophilic colloid as a synthetic hydrophilic macromolecular substance and the like including, for example, a gelatin derivative, a graft polymer of gelatin and other macromolecular substance, protein, a sugar derivative and a cellulose derivative or the mono- or co-polymers thereof.

The photographic emulsion layers and other hydrophilic colloidal layers of the silver halide photographic materials of the invention are hardened with a hardener which is capable of cross-linking the binder molecules to each other so as to increase the strength of the layer surfaces. Such hardeners may be used independently or in combination. It is desired to add the hardeners in such an amount as is not necessary to further add them in a processing liquid but capable of hardening a light-sensitive material, however, such hardeners may also be added to the processing liquid.

A plasticizer may further be added in the silver halide emulsion layers and/or the other hydrophilic colloidal layers of the silver halide photographic materials of the invention, with the purpose of increasing the softness of the above-mentioned layers.

The photographic emulsion layers and the other hydrophilic colloidal layers of the silver halide photographic materials of the invention are also allowed to contain a water-insoluble or hardly soluble synthetic polymer dispersed matter (i.e., the so-called latex), with the purpose of improving the dimensional stability and the like.

In the emulsion layers of the silver halide photographic materials of the invention, a dye-forming coupler for forming a dye through the coupling reaction thereof with the oxidation products of an aromatic primary amine developing agent such as a p-phenylenediamine derivative, an aminophenol derivative or the like, in the course of a color development process. Ordinarily, the dye-forming couplers are so selected as to form the respective dyes capable of absorbing the spectra with respect to each emulsion layer. Namely, a yellow dye-forming coupler is used in a blue light-sensitive emulsion layer, a magenta dye-forming coupler in a green light-sensitive emulsion layer and a cyan dye-forming coupler in a red light-sensitive emulsion layer, respectively. It is, however, allowed to prepare a silver halide photographic material in a different way from the above-mentioned coupler-and-layer combination, according to the purposes.

The yellow dye forming couplers include, for example, such an acylacetamido coupler as a benzoylacetanilide and a pivaloyl aceanilide; the magenta dye forming couplers include, besides the couplers of the invention, for example, a 5-pyrazolone coupler, a pyrazolobenzimidazole coupler, a pyrazolotirazole coupler, an open-chained acylacetonitrile coupler and the like; and the cyan dye forming couplers include, for example, a naphthol coupler, a phenol coupler and the like.

The above-mentioned dye forming couplers are desired to have, in the molecules thereof, the so-called ballast group which has not less than 8 carbon atoms and is capable of non-dispersing a coupler. These dye forming couplers may be either one of the 4-equivalent type in which 4 silver ions are to necessarily be reduced for forming a monomolecular dye or of the 2-equivalent type in which only the reduction of 2 silver ions would be enough.

Such a hyrophobic compounds as the dye forming couplers and the like which are unnecessary to be adsorbed on the surface of a silver halide crystal may be applied with various processes such as a solid disperson process, a latex disperson process, an oil-drop-in-water type emulsification-dispersion process and the like. Such processes may suitably be selected according to the chemical structures of the hydrophobic compounds such as the couplers and the like. The oil-drop-in-water type emulsification-dispersion processes applicable thereto include, for example, the conventionally well-known processes for dispersing such a hydrophobic compound as the couplers. In the above-mentioned well-known processes, normally, a high boiling organic solvent having a boiling point of not lower than 150° C. and, if required, a low boiling and/or water-soluble organic solvent are dissolved in combination and are then added into such a hydrophilic binder as an aqueous gelatin solution; and the resulted solution is emulsified and dispersed with a surface active agent by making use of such a dispersing means as an agitator, homogenizer, colloid mill, flow-jet mixer, ultrasonic device or like means; and then the resulted emulsified-dispersed matter is to be added into a hydrophilic colloidal layer aimed; provided that it is also allowed to add a process of removing the dispersion liquid or a process of removing the low boiling solvent at the same time when the dispersion is made.

The high boiling organic solvents include, for example, an organic solvent having a boiling point of not lower than 150° C., such as a phenol derivative incapable of reacting with the oxidation products of a color developing agent, a phthalic acid ester, a phosphoric acid ester, a citric acid ester, a benzoic acid ester, an alkylamide, an aliphatic acid ester, a trimesic acid ester and the like.

The dispersing aids to be used when a hydrophobic compound is dissolved in single low boiling solvent or in a combination thereof with a high boiling solvent and the resulted solution is dispersed in water mechanically or ultrasonically; such dispersing aids include, for example, an anionic, nonionic or cationic surface active agent.

With the purposes of preventing a problem, such as a color turbidity caused by the transference of the oxidation products of a color developing agent or an electron transferring agent between the emulsion layers (i.e., between the same color-sensitive layers and/or between the different color-sensitive layers) of the silver halide photographic materials of the invention; a deterioration in sharpness and a coarse graininess, an anticolor-foggant may be used.

The above-mentioned anticolor-foggants may be used in an emulsion layer in itself or may be used in an interlayer interposed between the adjacent emulsion layers thereto.

The hydrophilic colloidal layers such as a protective layer, an interlayer and the like of the silver halide photographic materials of the invention are allowed to contain an ultraviolet absorbing agent with the purposes of preventing a fog caused by a static discharge generated by rubbing the light-sensitive materials and avoiding the deterioration of an image caused by exposing the light-sensitive materials to ultraviolet rays.

To the silver halide photographic materials of the invention, there may be provided with the supplementary layers such as a filter layer, an antihalation layer and/or an antiirradiation layer. These layers and/or emulsion layers may also contain such a dyestuff as is flowing out from the light-sensitive materials or being bleached, in a developing process.

To the silver halide emulsion layers and/or the other hydrophilic colloidal layers of the silver halide photographic materials of the invention, there may be added with a matting agent with the purposes of reducing the gross of the light-sensitive materials and improving the retouchability and further avoiding the adhesion of the light-sensitive materials to each other.

To the silver halide photographic materials of the invention, there may be added with a sliding agent with the purpose of reducing a sliding friction.

To the silver halide photographic materials of the invention, there may be added with an antistatic agent with the purpose of preventing a static charge. Such an antistatic agent is sometimes provided to an antistatic layer arranged to the side of the support of the light-sensitve material whereon no emulsion is coated, or the antistatic agent may also be provided, in other cases, to a protective layer other than the emulsion layers, which is arranged to the side of the emulsion layer and/or the support whereon the emulsion is coated.

To the photographic emulsion layers and/or the other hydrophilic colloidal layers of the silver halide photographic materials of the invention, various surface active agents may be applied with the purposes of improving the coating behavior, preventing the static charge, improving the slidability, improving the emulsification-dispersion property, preventing the adhesion, improving the photographic characteristics such as a development acceleration, hardening, sensitization, and the like.

The photographic emulsion layers and other layers of the silver halide photographic materials of the invention are coated on the supports which include, for example, such a reflection type flexible support as a baryta paper or an α-olefin polymer coated paper, a synthetic paper and the like; such a semisynthetic or synthesized polymeric film as those of cellulose acetate, cellulose nitrate, polystyrene, polyvinyl chloride, polyethyleneterephthalate, polycarbonate, polyamide or the like; such a solid matter as a glass, metal, ceramic or like plate; and the like.

The silver halide photographic materials of the invention may be coated to the surface of the support thereof directly or with the interposition of one or not less than two subbing layers between them for improving the surface of the support on its adhesion property, antistatic property, dimensional stability, abrasion resistance, hardness, antihalation property, friction property and/or other properties, after applying a corona discharge, an ultraviolet ray irradiation, a flame treatment or the like to the surface of the support, if required.

In coating the silver halide photographic materials of the invention, a thickening agent may be used to improve the coatability. An extrusion coating method and a curtain coating method are particularly useful for this purpose, because two or more layers may be coated at the same time in these methods.

The silver halide photographic materials of the invention can be exposed to the electromagnetic waves within a certain spectral region to which an emulsion layer forming the photographic material of the invention is sensitive. There may be used any one of the well-known light sources for this purpose, including, for example, the rays of light emitted from a phosphor excited by natural light (i.e., daylight), a tungsten lamp, a fluoroscent lamp, a mercury lamp, a xenon arc lamp, a carbon arc lamp, a xenon flash lamp, a cathode-ray tube (CRT) flying spot, various laser-beams, a light-emitting diode (LED) light, an electron beam, an X-ray beam, a γ-ray beam, an α-ray beam and the like.

It is allowed to apply not only an exposure time from one millisecond to one second that is for the normal shutter speeds of a popular type camera, but also such an exposure time faster than one microsecond as those from 100 microseconds to one microsecond made with a CRT or a xenon flash lamp, and besides the above, a longer exposure not shorter than one second may also be made. Such exposures may further be made continuously or intermittently, either.

In this silver halide photographic materials of the invention, images may be reproduced in any color developments well-known to the skilled in the art.

In the invention, the aromatic primary amine color developing agents to be used in a color developer include any well-known ones being popularly used in various color photographic processes. These developers include, for example, an aminophenol derivative and a p-phenylenediamine derivative. These compounds are generally used in the form of the salts thereof, such as a chloride or sulfate, rather than in the free state, because the salts are more stable. Such compounds are generally used at a concentration of from about 0.1 g to about 30 g liter of a color developer used and more preferably from about 1 g to about 15 g per liter of the color developer used.

Such aminophenol developers include, for example, o-aminophenol, p-aminophenol, 5-amino-2oxytoluene, 2-amino-3-oxytoluene, 2-oxy-3-amino-1,4-dimethylbenzene, and the like.

The particularly useful aromatic primary amine color developers include, for example, a N,N'-dialkyl-p-phenylene diamine compound, and the alkyl and phenyl groups thereof may be substituted by any arbitrary substituents. Among the compounds, the particularly useful compounds include, for example, a N,N'-diethyl-p-phenylenediamine chloride, a N-methyl-p-phenylenediamine chloride, a N,N'-dimethyl-p-phenylenediamine chloride, 2-amino-5-(N-ethyl-N-dodecylamino)-toluene, a N-ethyl-N-β-methanesulfonamidoethyl-3-methyl-4-aminoaniline sulfate, N-ethyl-N-β-hydroxyethylaminoaniline, 4-amino-3-methyl-N,N'-diethylaniline, 4-amino-N-(2-methoxyethyl)-N-ethyl-3-methylaniline-p-toluene sulfonate, and the like.

In the processes of the invention, the color developers used contain the above-mentioned aromatic primary amine color developing chemicals and in addition they are further allowed to contain any various components which are normally added to color developers, including, for example, such an alkalizer as sodium hydroxide, sodium carbonate, potassium carbonate; an alkali metal sulfite, an alkali metal bisulfite, an alkali metal thiocyanate, an alkali metal halide, benzyl alcohol, a water softening agent, a thickening agent and the like. A pH value of the above-mentioned color developers is normally not lower than 7 and most popularly from about 10 to about 13.

In the invention, a silver halide photographic material is color-developed and is then processed with a processing liquid capable of fixing the light-sensitive material. When the processing liquid capable of fixing is a fixer, a bleaching step is to be taken before the fixing step. As for the bleaching agents to be used in such a bleaching step, the metallic complex salts of an organic acid are used. Such metallic complex salts have the function that a metallic silver produced by a development is oxidized and restored to the silver halide thereof and, at the same time, the undeveloped color portions of a color-developing chemical are color-developed. Such a metal complex salts is composed of an aminopolycarboxylic acid or such an organic acid as oxalic acid, citric acid or the like, with which such a metal ions as that of iron, cobalt, copper or the like are coordinated. The organic acids most preferably useful to form such a metal complex salt thereof as mentioned above include, for example, a polycarboxylic acid or aminocarboxylic acid. These polycarboxylic acid or aminocarboxylic acid may alternatively be an alkali metallic salt, an ammonium salt or a water-soluble amine salt.

The typical examples thereof may be give below:

[1] Ethylenediaminetetraacetic acid,
[2] Nitrilotriacetic acid,
[3] Iminodiacetic acid,
[4] Disodium ethylenediaminetetracetate,
[5] Tetra(Tri)methylammonium ethylendiaminetetraacetate
[6] Tetrasodium ethylenediaminetetraacetate, and
[7] Sodium nitrilotriacetate.

The bleaching agents to be used therein contain various additives as well as the above-mentioned metallic complex salts of the organic acids to serve as the bleaching agents. It is desirable that such an additive contains an alkali halide or ammonium halide in particular including, for example, a rehalogenater such as potassium bromide, sodium bromide, sodium chloride, ammonium bromide or the like, a metallic salt and a chelating agent.

It is also allowed to suitably add such a pH buffer as a borate, oxalate, acetate, carbonate, phosphate or like salts and such a matter as an alkylamine, polyethylene oxide or the like which is well-known to be put into an ordinary type bleaching liquid.

In addition to the above, the fixers and the bleach-fixers are also allowed to contain a single or not less than two kinds of pH buffers comprising such a sulfite as ammonium sulfite, potassium sulfite, ammonium bisulfite, potassium bisulfite, sodium bisulfite, ammonium metabisulfite, potassium metabisulfite, sodium metabisulfite and the like, and various kinds of salts such as a boric acid, borax, sodium hydroxide, potassium hydroxide, sodium carbonate, potassium carbonate, sodium bisulfite, sodium bicarbonate, potassium bicarbonate, acetic acid, sodium acetate, ammonium hydroxide and the like.

When a process of the invention is carried out while adding a bleach-fix replenisher to a bleach-fix solution (bath), the bleach-fix solution (bath) may contain a thiosulfate, a thiocyanate, a sulfite or the like, or the bleach-fix replenisher may contain the above-mentioned salts to be replenished to a processing bath.

In the invention, for a further activation of a bleach-fixer, the air or oxygen may be blown, if desired, through the bleach-fixing bath and the reservoir of a bleach-fix replenisher, or such a suitable oxidizer as hydrogen peroxide, a bromate, a persulfate and the like may suitably be added thereto.

With the silver halide photographic materials containing the magenta couplers of the invention and the amine compounds represented by the General Formula [XII], the fastness of a magenta dye-image against light, heat or humidity can substantially be improved as compared with those having so far been poor and, more particularly, a light discoloration, a light fading and a Y-stain caused by light, heat or humidity in color-undeveloped areas can excellently be prevented. In addition to the above, the light-resistance of the magenta dye-imaging can further be improved by making use of the phenol type compounds represented by the General Formula [XIII] and the phenylether type compounds.

EXAMPLES

Referring now to the preferred embodiments of the invention, the invention will more detailedly be described below. It is, however, to be understood that the invention shall not be limited thereto.

EXAMPLE 1

Sample 1 was prepared in such a manner that a gelatin in an amount of 15.0 mg/100 $cm^2$ and the undermentioned comparative magenta coupler (1) in an amount of 6.0 mg/100 $cm^2$ were dissolved together with a 2,5-di-tert-octyl hydroquinone in an amount of 0.8 mg/100 $cm^2$ in a dibutyl phthalate in an amount of 5.0 mg/100 $cm^2$ and the resulted solution was emulsified and dispersed and was then mixed with a silver chlorobromide emulsion containing silver bromide in a proportion of 80 mol % in an amount of 3.8 mg/100 $cm^2$ in terms of the silver to be coated, and the resulted mixture was coated onto a paper support which had been polyethylene-laminated on both sides, and dried.

On the other hand, Samples 4, 7, 10, 13, 16 and 19 were prepared respectively in the similar manner to the above, except that the magenta couplers used in the Sample 1 were changed into the comparative couplers (2), (3) and (4) and the magenta couplers 5, 7 and 44 of the invention.

Further, Samples 2, 5, 8, 11, 14, 17 and 20 were prepared respectively in the similar manner to that taken in the above-mentioned Samples 1, 4, 7, 10, 13, 16 and 19, except that the aforementioned PH-13 were added, in the same mol amount as the amount of the couplers used, so as to serve as a magenta dye-image stabilizer.

Still further, Samples 3, 6, 9, 12, 15, 18 and 21 and prepared respectively in the similar manner to the above, except that the amine compound HI-2 of the invention was added, in place of the above-mentioned PH-13, the same mol amount as that of the coupler used.

Comparative Coupler (1)

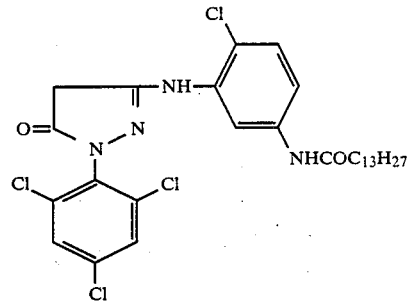

Comparative Coupler (2)

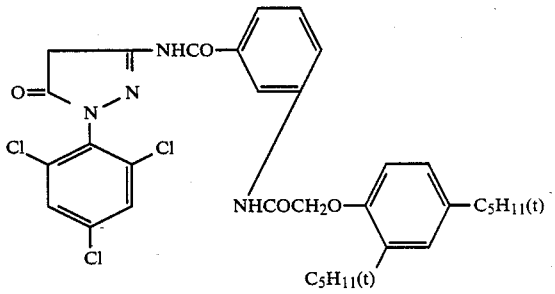

Comparative Coupler (3)

-continued

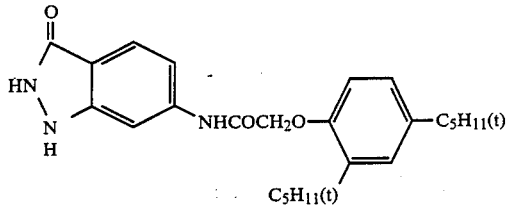

Comparative Coupler (4)

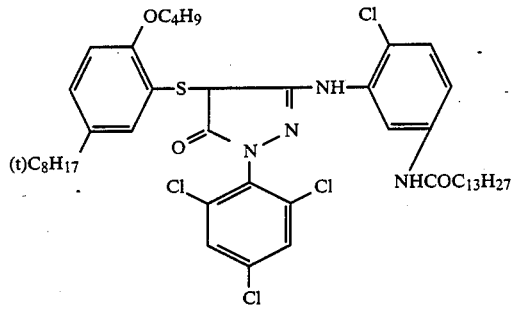

The prepared samples were exposed to light through an optical wedge in an ordinary method and were then processed in the following steps, respectively.

| [Processing Steps] | Temperature | Time | |
|---|---|---|---|
| Color developing | 33° C. | 3 min. | 30 sec. |
| Bleach-fixing | 33° C. | 1 | 30 |
| Washing | 33° C. | 3 | 00 |
| Drying | 50–80° C. | 2 | 00 |

The composition of each processing liquid is as follows:

| | |
|---|---|
| [Color Developer] | |
| Benzyl alcohol | 12 ml |
| Diethylene glycol | 10 ml |
| Potassium carbonate | 25 g |
| Sodium bromide | 0.6 g |
| Anhydrous sodium sulfite | 2.0 g |

-continued

| | |
|---|---|
| Hydroxylamine sulfate | 2.5 g |
| N—ethyl-N—β-methanesulfonamidethyl-3-methyl-4-aminoaniline sulfate | 4.5 g |
| Add water to make | 1 liter |
| Adjust the pH value with NaOH to pH | 10.2 |
| [Bleach-fixer] | |
| Ammonium thiosulfate | 120 g |
| Sodium metabisulfite | 15 g |
| Anhydrous sodium sulfite | 3 g |
| EDTA ferric ammonium salt | 65 g |
| Add water to make | 1 liter |
| Adjust the pH value to pH | 6.7~6.8 |

The each density of the Samples 1 through 21 processed as above was measured under the following conditions by making use of a densitometer (Model KD-7R manufactured by Konishiroku Photo Industry Co., Ltd., Japan).

Each of the above-mentioned processed Samples were irradiated with a xenon fade-o-meter for 10 days and the light resistance of the dye images and the Y-stains in the color-undeveloped areas were checked up, respectively. The results obtained are shown in Table-1.

The evaluation items of the light-resistance of the dye images are as follows:

[Rate of residual dye density]

A percentage of dye density remaining at the time of completing a light-resistance test to the dye density prior to a light-resistance test which is regarded as 1.0.

[YS]

A value obtained by deducting a density value of a Y-stain prior to a light-resistance test from the density value of a Y-stain at the time of completing the light-resistance test.

[Discoloration Degree]

A value obtained by deducting a value of a yellow density/a magenta density prior to a light-resistance test which is regarded as 1.0 from a value of a yellow density/a magenta density at the time of completing the light-resistance test. This value means that the greater this value is, the more a color tone is apt to be changed from magenta into a yellowish tone.

TABLE 1

| Sample No. | Coupler | Dye-image Stabilizer | Light-resistance: Dye residual rate | Light-resistance: YS | Light-resistance: Discoloration degree | Sensitivity (Sample 1 is regarded as 100) |
|---|---|---|---|---|---|---|
| 1 (Comparative) | Comparative coupler (1) | — | 50% | 0.54 | 0.34 | 100 |
| 2 (Comparative) | Comparative coupler (1) | PH-13 | 79 | 0.51 | 0.27 | 97 |
| 3 (Comparative) | Comparative coupler (1) | HI-2 | 61 | 0.70 | 0.75 | 83 |
| 4 (Comparative) | Comparative coupler (2) | — | 42 | 0.51 | 0.38 | 95 |
| 5 (Comparative) | Comparative coupler (2) | PH-13 | 73 | 0.50 | 0.36 | 94 |
| 6 (Comparative) | Comparative coupler (2) | HI-2 | 59 | 0.63 | 0.71 | 79 |
| 7 (Comparative) | Comparative coupler (3) | — | 35 | 0.43 | 0.44 | 85 |
| 8 (Comparative) | Comparative coupler (3) | PH-13 | 72 | 0.39 | 0.39 | 83 |
| 9 (Comparative) | Comparative coupler (3) | HI-2 | 53 | 0.52 | 0.65 | 72 |
| 10 (Comparative) | Comparative coupler (4) | — | 55 | 0.17 | 0.36 | 103 |
| 11 (Comparative) | Comparative | PH-13 | 75 | 0.19 | 0.31 | 100 |

TABLE 1-continued

| Sample No. | Coupler | Dye-image Stabilizer | Light-resistance Dye residual rate | YS | Discoloration degree | Sensitivity (Sample 1 is regarded as 100) |
|---|---|---|---|---|---|---|
| 12 (Comparative | coupler (4) Comparative coupler (4) | HI-2 | 62 | 0.31 | 0.58 | 80 |
| 13 (Comparative) | 5 | — | 22 | 0.06 | 0.78 | 105 |
| 14 (Comparative) | 5 | PH-13 | 70 | 0.11 | 0.74 | 101 |
| 15 (Invention) | 5 | HI-2 | 74% | 0.12 | 0.15 | 100 |
| 16 (Comparative) | 7 | — | 23 | 0.06 | 0.74 | 110 |
| 17 (Comparative) | 7 | PH-13 | 69 | 0.07 | 0.70 | 108 |
| 18 (Invention) | 7 | HI-2 | 73 | 0.09 | 0.13 | 106 |
| 19 (Comparative) | 44 | — | 35 | 0.06 | 0.77 | 98 |
| 20 (Comparative | 44 | PH-13 | 74 | 0.10 | 0.75 | 97 |
| 21 (Invention) | 44 | HI-2 | 76 | 0.11 | 0.14 | 97 |

As is obvious from the Table-1, it may be understood that Samples 13, 16 and 19 prepared by making use of the couplers of the invention having no secondary absorption are very hard to cause a Y-stain when putting them to the light-resistance tests, as compared with Samples 1 and 4 prepared with the conventional 4-equivalent 3-anilino-5-pyrazolone type couplers and Sample 7 prepared with the conventional indazolone type couplers, and that a discoloration and fading are readily be caused by light, from the viewpoints of the dye residual rates and discoloration degrees of the dye-image areas thereof obtained from the light-resistance tests.

Samples 14, 17 and 20 are those prepared by making use of the couplers of the invention and the conventionally known magenta dye-image stabilizer PH-13 in combination, and it may be recognized that they are actually improved on the light fading of the dye-images, however, the discoloration thereof cannot be improved.

Further, from the Samples 3, 6, 9 and 12, it is understood that a discoloration prevention effect cannot so much be expected and a Y-stain is caused and, further, the sensitivity is lowered, when using the amine compounds of the invention and the conventional 5-pyrazolone type and indazolone type couplers in combination.

Meanwhile, from the Samples 15, 18 and 21 prepared with the couplers and amine compounds each of the invention, it is understood that the discoloration and fading are less caused in the dye-images and Y-stains are almost not caused in the color-undeveloped areas and further the sensitivity thereof are not lowered.

EXAMPLE 2

Samples 22 through 30 were coated in the same manner as in Example 1, except that the couplers and the magenta dye-image stabilizers were used in combination as shown in Table-2, and they were then processed in the steps described in Example 1, and further these samples were subjected to the light-resistance tests in the same manner as in Example 1. The results therefrom are shown in Table-2.

TABLE 2

| Sample No. | Magenta coupler | Dye-image stabilizer | Light-resistance Dye residual rate | YS | Discoloration degree | Sensitivity (That of Sample 1 is regarded as 100) |
|---|---|---|---|---|---|---|
| 22 (Comparative) | 41 | — | 32% | 0.06 | 0.70 | 100 |
| 23 (Comparative) | " | PH-8 | 74 | 0.07 | 0.65 | 98 |
| 24 (Comparative) | " | PH-10 | 71 | 0.06 | 0.67 | 100 |
| 25 (Invention) | " | HI-43 | 76 | 0.10 | 0.12 | 98 |
| 26 (Invention) | " | HI-71 | 77 | 0.09 | 0.15 | 97 |
| 27 (Invention) | " | HI-43 +PH-8 | 83 | 0.12 | 0.17 | 96 |
| 28 (Invention) | " | HI-43 +PH-10 | 79 | 0.11 | 0.17 | 97 |
| 29 (Invention) | " | HI-71 +PH-8 | 83 | 0.10 | 0.19 | 97 |
| 30 (Invention) | " | HI-71 +PH-10 | 82 | 0.10 | 0.18 | 98 |

In the Table-2, the Samples 27, 28, 29 and 30 were prepared by making use of the HI compounds and the PH compounds in a proportion of 2:1 in terms of mol ratios, and the total amount of the dye-image stabilizers was the same as the mol amount of the dye-image stabilizers used in the other samples.

As is apparent from the Table-2, when using the amine compound dye-image stabilizers of the invention and the conventional type dye-image stabilizers were used in combination in the couplers of the invention, that is, in the cases of the Samples 27, 28, 29 and 30, it is apparently recognized that the discoloration degrees are somewhat increased when testing the light-resistance thereof, while the multiplied effects are displayed in the dye residual rates by the combination use of the above-mentioned dye-image stabilizers.

EXAMPLE 3

Sample 31, a multicolor silver halide photographic material, was prepared by coating the following layers on a paper support polyethylene-laminated on both sides thereof in the order from the support.

1st layer: a blue-sensitive silver halide emulsion layer

The 1st layer was coated in the proportions of 68 mg/100 $cm^2$ of α-pivaloyl-α-(2,4-dioxo-1-benzylimidazolidine-3-yl)-2-chloro5-[γ-(2,4di-t-amylphenoxy)butylamido]-acetanilide to serve as a yellow coupler; 3.2 mg/100 $cm^2$ in terms of silver of blue-sensitive silver chlorobromide emulsion containing silver bromid of 85 mol %; 3.5 mg/100 $cm^2$ of dibutyl phthalate; and 13.5 mg/100 $cm^2$ of gelatin.

2nd layer: An interlayer

This layer was provided with 2,5-di-t-octyl hydroquinone in an amount of 0.5 mg/100 $cm^2$; butyl phthalate in an amount of 0.5 mg/100 $cm^2$; and gelatin in an amount of 9.0 mg/100 $cm^2$.

3rd layer: A green-sensitive silver halide emulsion layer

This layer was provided with the aforementioned magenta coupler 36 in an amount of 3.5 mg/100 $cm^2$; a green-sensitive silver chlorobromide emulsion containing silver bromide of 80 mol %, in an amount of 2.5 mg/100 $cm^2$ in terms of silver; dibutyl phthalate in an amount of 3.0 mg/100 $cm^2$; and gelatin in an amount of 12.0 mg/100 $cm^2$.

4th layer: An interlayer

This layer was provided with 2-(2-hydroxy-3-sec-butyl-5-t-butylphenyl)benzotriazole to serve as a UV absorber in an amount of 7.0 mg/100 $cm^2$; dibutyl phthalate in an amount of 6.0 mg/100 $cm^2$; 2,5-di-t-octyl hydroquinone in an amount of 0.5 mg/100 $cm^2$; and gelatin in an amount of 12.0 mg/100 $cm^2$.

5th layer: A red-sensitive silver halide emulsion layer

This layer was provided with 2-[α-(2,4-di-t-pentylphenoxy)butanamido]-4,6-dichloro-5-ethylphenol to serve as the cyan coupler in an amount of 4.2 mg/100 $cm^2$; a red-sensitive silver halide emulsion containing silver bromide of 80 mol % in an amount of 3.0 mg/100 $cm^2$ in terms of silver; tricresyl phosphate in an amount of 3.5 mg/100 $cm^2$; and gelatin in an amount of 11.5 mg/100 $cm^2$.

6th layer: A protective layer

This layer was provided with gelatin in an amount of 8.0 mg/100 $cm^2$.

The multilayered Samples 32 through 40 were prepared by adding into the 3rd layer of the Sample 31 with the amine compound dye-image stabilizers of the invention in the proportions indicated in the Table-3 and were then exposed to light and processed, respectively, in the same manner as in the Example 1, and were subjected to the light-resistance tests, (i.e., they were irradiated with a xenon fade-o-meter for 15 days). The results therefrom are shown also in the Table-3.

TABLE 3

| Sample No. | Dye-image stabilizer | Amt. added: mol %/coupler | Light-resistive magenta dye-image residual rate |
|---|---|---|---|
| 31 (Comparative) | — | — | 21 |
| 32 (Invention) | HI-7 | 50 | 53 |
| 33 (Invention) | " | 100 | 64 |
| 34 (Invention) | " | 150 | 80 |
| 35 (Invention) | HI-8 | 50 | 51 |
| 36 (Invention) | " | 100 | 61 |
| 37 (Invention) | " | 150 | 78 |
| 38 (Invention) | HI-77 | 50 | 47 |
| 39 (Invention) | " | 100 | 59 |
| 40 (Invention) | " | 150 | 72 |

From the results shown in the Table-3, it is understood that the amine compounds dye-image stabilizers of the invention are effective on the stabilization of dye-images formed by the magenta couplers of the invention, and that the more the amount thereof are added, the greater the effects will become. As compared with the Sample 31, the Samples 32 through 40 are extremely less in the discoloration of the dye-images thereof when testing the light-resistance thereof. In addition to the above, the samples of the invention are extremely less in discoloration and fading of the magenta dyes and also excellent in color balance between the yellow and cyan couplers, as a silver halide photographic material as a whole, so that they can be kept in the extremely excellent color reproducible conditions.

What is claimed is:

1. A silver halide photographic material containing at least one coupler of formula [II], [III], [IV], [V], [VI], or [VII] and at least one compound of formula [XII]:

Formula [II]

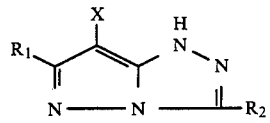

Formula [III]

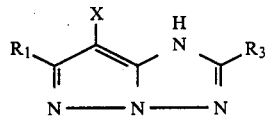

Formula [IV]

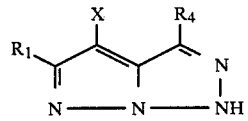

Formula [V]

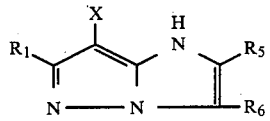

Formula [VI]

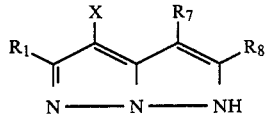

Formula [VII]

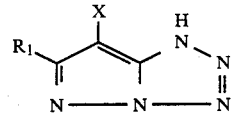

wherein $R_1$ and $R_8$ each is a hydrogen atom or a monovalent substituent, and X is a hydrogen atom or a substituent cabable of being released upon reaction with the oxidation product of a color developing agent; and R is a hydrogen atom or a substituent;

Formula [XII]

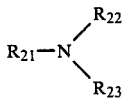

wherein $R_{21}$ represents a hydrogen atom or a group selected from the group consisting of an alkyl group, an alkenyl group, a cycloalkyl group and aryl group; $R_{22}$ and $R_{23}$ independently represent a group selected from the group consisting of an alkyl group, an alkenyl group, a cycloalkyl group and an aryl group.

2. The silver halide photographic material of claim 1, wherein each of $R_1$ to $R_8$ is selected from the group consisting of a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a residue of a spyro compound, a residue of a bridged hydrocarbon compound, an alkoxy group, an aryloxy group, a heterocyclic oxy group, a siloxy group, an acyloxy group, a carbamoyloxy group, an amino group, an acylamino group, a sulfonamide group, an imide group, an ureido group, a sulfamoylamino group, an alkoxycarbonylamino group, an aryloxycarbonylamino group, an aryloxycarbonylamino group, an alkylthio group, an arylthio group and a heterocyclic thio group.

3. The silver halide photographic material of claim 1, wherein an amount of said coupler is from $1\times10^{-3}$ to 1 mole per mole of silver halide contained in a silver halide emulsion containing said coupler.

4. The silver halide photographic material of claim 3, wherein an amount of said coupler is from $1\times10^{-2}$ to $8\times10^{-1}$ mole per mole of silver halide contained in a silver halide emulsion containing said coupler.

5. The silver halide photographic material of claim 1, wherein said alkyl group represented by $R_{21}$, $R_{22}$ or $R_{23}$ is a straight chain or branched alkyl group containing 1 to 24 carbon atoms.

6. The silver halide photographic material of claim 1, wherein said cycloalkyl group represented by $R_{21}$, $R_{22}$ or $R_{23}$ is a cycloalkyl group containing 5 to 24 of carbon atoms.

7. The silver halide photographic material of claim 1, wherein said alkenyl group represented by $R_{21}$, $R_{22}$ or $R_{23}$ is an alkenyl group containing 3 to 24 carbon atoms.

8. The silver halide photographic material of claim 1, wherein said aryl group represented by $R_{21}$, $R_{22}$ or $R_{23}$ is a phenyl group or a naphthyl group.

9. The silver halide photographic material of claim 1 wherein said coupler is represented by formula [II].

10. The silver halide photographic material of claim 1 wherein the amount of the compound represented by the formula [XII] to be contained in said photographic material is 5 to 400 mole % with respect to 100 mole % of said coupler.

11. The silver halide photographic material of claim 10 wherein the amount of the compound represented by the formula[XII] to be contained in said photographic material is 10 mol % with respect to 100 mole % of said coupler.

12. The silver halide photographic material of claim 1 wherein said coupler and said compound are contained in the same silver halide emulsion layer.

13. A silver halide photographic material comprising a support and at least one photosensitive silver halide emulsion layer, at least one said layer containing a coupler of claim 1.

14. The silver halide color photographic material of claim 13 having a plurality of photosensitive silver halide emulsion layers thereon, said plurality comprising at least one blue-sensitive silver halide emulsion layer containing a yellow dye-forming coupler, at least one green-sensitive silver halide emulsion layer containing at least one said coupler also containing at least one said compound, and at least one red-sensitive silver halide emulsion layer containing a cyan dye-forming coupler.

* * * * *